US010482838B2

(12) United States Patent
Sasaki

(10) Patent No.: US 10,482,838 B2
(45) Date of Patent: Nov. 19, 2019

(54) ACTIVE-MATRIX DISPLAY DEVICE AND METHOD FOR DRIVING THE SAME

(71) Applicant: Sharp Kabushiki Kaisha, Sakai, Osaka (JP)

(72) Inventor: Osamu Sasaki, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/211,317

(22) Filed: Dec. 6, 2018

(65) Prior Publication Data

US 2019/0197976 A1 Jun. 27, 2019

(30) Foreign Application Priority Data

Dec. 19, 2017 (JP) ..... 2017-242432

(51) Int. Cl.
*G09G 3/36* (2006.01)

(52) U.S. Cl.
CPC ... *G09G 3/3677* (2013.01); *G09G 2300/0876* (2013.01); *G09G 2310/0283* (2013.01); *G09G 2310/0286* (2013.01); *G09G 2310/06* (2013.01); *G09G 2310/08* (2013.01); *G09G 2320/0219* (2013.01)

(58) Field of Classification Search
CPC ..... G09G 3/3648; G09G 3/3677; G09G 2300/0426; G09G 2300/0876; G09G 2310/0281; G09G 2310/0283; G09G 2310/0286; G09G 2310/06; G09G 2310/08; G09G 2320/0219
See application file for complete search history.

(56) References Cited

U.S. PATENT DOCUMENTS

2004/0090412 A1* 5/2004 Jeon ..... G09G 3/3648 345/100
2005/0248550 A1 11/2005 Kobayashi et al.
2010/0141570 A1* 6/2010 Horiuchi ..... G09G 3/3611 345/100
2018/0068615 A1 3/2018 Imai

FOREIGN PATENT DOCUMENTS

JP 2002-169513 A 6/2002
JP 2004-212426 A 7/2004
WO 2016/163299 A1 10/2016

* cited by examiner

*Primary Examiner* — Stacy Khoo
(74) *Attorney, Agent, or Firm* — Keating & Bennett, LLP

(57) ABSTRACT

This application discloses an active-matrix display device capable of providing satisfactory display free from display irregularities on a non-rectangular display portion, such as a notched display portion, while avoiding an increased circuit scale and other adverse factors. In such an active-matrix liquid crystal display device including a notched display portion, pulses of gate clock signals GCK and GCKB corresponding to pulses of scanning signals are subjected to waveform rounding in accordance with time constants of scanning signal lines to which the scanning signals are to be applied. As a result, the waveforms of all scanning signals to be applied to the scanning signal lines are rounded to almost the same degree. Thus, each pixel forming portion is approximately equal in pixel voltage reduction amount ΔVp upon turning off of a pixel switching element.

9 Claims, 11 Drawing Sheets

ACTIVE-MATRIX DISPLAY DEVICE AND METHOD FOR DRIVING THE SAME

BACKGROUND OF THE INVENTION

1. Field of the Invention

The present invention relates to active-matrix display devices, more specifically to an active-matrix display device including a plurality of pixel forming portions arranged in a matrix, each of which includes a switching element, such as a thin-film transistor, and data holding capacitance, such as pixel capacitance, and the invention also relates to a method for driving the same.

2. Description of the Related Art

In an active-matrix liquid crystal display device, a plurality of data signal lines (also referred to as "source lines"), a plurality of scanning signal lines (also referred to as "gate lines") crossing the data signal lines, and a plurality of pixel forming portions arranged in a matrix along the data signal lines and the scanning signal lines are formed in a display portion such as a liquid crystal panel.

In such an active-matrix liquid crystal display device, each pixel forming portion includes a transistor (typically, a thin-film transistor) serving as a pixel switching element, and when the switching element (hereinafter, the switching element is assumed to be an N-channel transistor, which will be abbreviated as an "N-ch transistor") is turned off, a pixel electrode voltage (referred to below as a "pixel voltage") Vp is reduced because of parasitic capacitance in the transistor. In such a case, a pixel voltage reduction amount (also referred to as a "pull-in voltage" or a "feed-through voltage") ΔVp is represented by an equation below where the symbol "Cp" denotes pixel capacitance, the symbol "Cgd" denotes parasitic capacitance between a gate terminal of the N-ch transistor serving as a pixel switching element and a drain terminal serving as a pixel-electrode-side conduction terminal, and it is assumed that the voltage of a scanning signal that is provided to the gate terminal of the N-ch transistor instantly changes from an H-level gate voltage Vgh, which is an on-voltage, to an L-level gate voltage Vgl, which is an off-voltage.

$$\Delta Vp=\{Cgd/(Cp+Cgd)\}(Vgh-Vgl) \quad (1)$$

In relation to the display device disclosed in the present application, International Publication WO 2016/163299 describes an active-matrix display device including a non-rectangular display portion, and the display device has a scanning signal line driver circuit configured such that the longer a scanning signal line of the display portion is, the shorter a time period is taken for a scanning signal voltage to be provided to the scanning signal line to change from an on-voltage of a pixel switching element to an off-voltage. Moreover, Japanese Laid-Open Patent Publication No. 2002-169513 describes a scanning line driver for a liquid crystal display panel, and the scanning line driver is configured such that a scanning line drive voltage (output signal) exhibits a gradual falling waveform, rather than dropping sharply, in accordance with drive capability of a switching element.

In the case where the scanning signal provided to the gate terminal of the N-ch transistor serving as a pixel switching element instantly changes from the on-voltage Vgh to the off-voltage Vgl, as described above, the pixel voltage reduction amount ΔVp, i.e., the pull-in voltage, due to such a change of the scanning signal voltage, is provided by equation (1). However, in actuality, the scanning signal does not instantly change from the on-voltage Vgh to the off-voltage Vgl because of the presence of capacitance Cgl and resistance Rgl of the scanning signal line, and the falling waveform of the scanning signal is rounded. As the capacitance Cgl or the resistance Rgl of the scanning signal line increases, i.e., as a time constant of the scanning signal line increases, the falling waveform becomes more rounded (i.e., fall time becomes longer), and the amount of electric charge flowing into the pixel electrode (i.e., the pixel capacitance) increases during the course of the scanning signal voltage changing from the on-voltage Vgh to the off-voltage Vgl. Accordingly, in the case of a display portion having scanning signal lines with non-uniform lengths, such as a non-rectangular display portion or a display portion with a notch (i.e., a cutout) as shown in FIG. 1 to be described later, the capacitance Cgl and the resistance Rgl of the scanning signal line are not uniform as well, and therefore, the pixel voltage reduction amount ΔVp varies among the scanning signal lines connected to the pixel switching elements. As a result, the display portion suffers from display irregularities, such as differences in luminance, and cannot provide satisfactory display.

On the other hand, the time for the scanning signal voltage that is to be provided to the scanning signal line to change from the on-voltage of the pixel switching element to the off-voltage, i.e., on-to-off transition time, can be set shorter as the scanning signal line becomes longer, as in the active-matrix display device described in International Publication WO 2016/163299, whereby the pixel voltage reduction amount ΔVp can be set constant. However, an attempt to generate such a scanning signal on the basis of a configuration disclosed in International Publication WO 2016/163299 (see FIGS. 3 and 18 of the publication) requires a plurality of additional control signals, resulting in more complex and larger-scale configurations of components such as the scanning signal line driver circuit (i.e., the gate driver).

SUMMARY OF THE INVENTION

Therefore, it is desired to provide an active-matrix display device capable of providing satisfactory display free from display irregularities on a display portion having scanning signal lines with non-uniform lengths, such as a notched display portion, while avoiding an increased circuit scale and a more complex circuit configuration, and it is also desired to provide a method for driving the same.

Some embodiments of the present invention are directed to an active-matrix display device including: a display portion including a plurality of data signal lines, a plurality of scanning signal lines crossing the data signal lines, and a plurality of pixel forming portions arranged in a matrix along the data signal lines and the scanning signal lines, at least two of the scanning signal lines being different in time constant from each other; a scanning signal line driver circuit configured to generate a plurality of scanning signals respectively provided to the scanning signal lines; a scanning clock generation circuit configured to generate a scanning clock signal to be provided to the scanning signal line driver circuit; and a waveform control circuit configured to control a waveform of the scanning clock signal, the waveform control circuit being provided inside or outside the scanning clock generation circuit. Each of the pixel forming portions includes a capacitive electrode serving as one of electrodes that form predetermined capacitance, and a field-effect transistor serving as a pixel switching element and having a first conduction terminal connected to one of the data signal lines, a second conduction terminal connected to the capacitive electrode, and a control terminal connected to one of the scanning signal lines. The scanning signal line driver circuit includes a shift register configured to sequentially transfer an inputted start pulse and having stages corresponding in number to the scanning signal lines, and a plurality of analog switches respectively connected to the scanning signal lines and being turned on or off by output signals from the stages of the shift register that correspond to the scanning signal lines to which the analog switches are connected. The scanning signal line driver circuit applies a plurality of signals respectively to the scanning signal lines as the scanning signals, the plurality of signals being obtained by sampling the scanning clock signal by the analog switches. The waveform control circuit controls the waveform of the scanning clock signal such that a time period taken for a voltage of the scanning clock signal to change from an on-voltage for rendering the pixel switching element in ON-state to an off-voltage for rendering the pixel switching element in OFF-state, at a fall or rise of a pulse included in the scanning clock signal, increases as the scanning signal line to which a scanning signal including the pulse is to be applied decreases in time constant.

In the embodiments of the invention, the time period taken for the voltage of the scanning clock signal to change from the on-voltage to the off-voltage at the fall or rise of each pulse included in the scanning clock signal, increases as the scanning signal line to which a scanning signal including the pulse is to be applied decreases in time constant. By sampling such scanning clock signal by a plurality of analog switches, a plurality of signals are obtained and respectively applied to the scanning signal lines of the display portion as scanning signals. As a result, all scanning signals applied to the scanning signal lines are subjected to waveform rounding to almost the same degree, and therefore, in any pixel forming portion, the pixel switching element is approximately equal in pixel voltage reduction amount during an on-to-off transition period (i.e., a period in which a voltage at a control terminal changes from the on-voltage to the off-voltage). Thus, it is possible to provide satisfactory image display free from display irregularities by inhibiting a luminance difference from occurring due to the difference in time constant (i.e., length) among the scanning signal lines of the display portion, while avoiding an increased circuit scale and a more complex circuit configuration.

Other embodiments of the invention are directed to a method for driving an active-matrix display device provided with a display portion including a plurality of data signal lines, a plurality of scanning signal lines crossing the data signal lines, and a plurality of pixel forming portions arranged in a matrix along the data signal lines and the scanning signal lines, at least two of the scanning signal lines being different in time constant from each other. The method includes: a scanning signal line driving step of generating a plurality of scanning signals respectively provided to the scanning signal lines; a scanning clock generation step of generating a scanning clock signal for generating the scanning signals by the scanning signal line driving step; and a waveform control step of controlling a waveform of the scanning clock signal. Each of the pixel forming portions includes a capacitive electrode serving as one of electrodes that form predetermined capacitance, and a field-effect transistor serving as a pixel switching element and having a first conduction terminal connected to one of the data signal lines, a second conduction terminal connected to the capacitive electrode, and a control terminal connected to one of the scanning signal lines. The scanning signal line driving step includes: sequentially transferring an inputted start pulse within a shift register having stages corresponding in number to the scanning signal lines; turning on or off a plurality of analog switches respectively connected to the scanning signal lines by output signals from the stages of the shift register that correspond to the scanning signal lines to which the analog switches are connected; and applying a plurality of signals respectively to the scanning signal lines as the scanning signals, the plurality of signals being obtained by sampling the scanning clock signal by the analog switches. In the waveform control step, the waveform of the scanning clock signal is controlled such that a time period taken for a voltage of the scanning clock signal to change from an on-voltage for rendering the pixel switching element in ON-state to an off-voltage for rendering the pixel switching element in OFF-state, at a rise or fall of a pulse included in the scanning clock signal, increases as the scanning signal line to which a scanning signal including the pulse is to be applied decreases in time constant.

The above and other objectives, features, modes, and effects of the invention will become more apparent from the following detailed description of the invention with reference to the accompanying drawings.

DESCRIPTION OF THE EMBODIMENTS

Hereinafter, embodiments will be described with reference to the accompanying drawings.

1. First Embodiment

1.1 Overall Configuration

Figure 1:
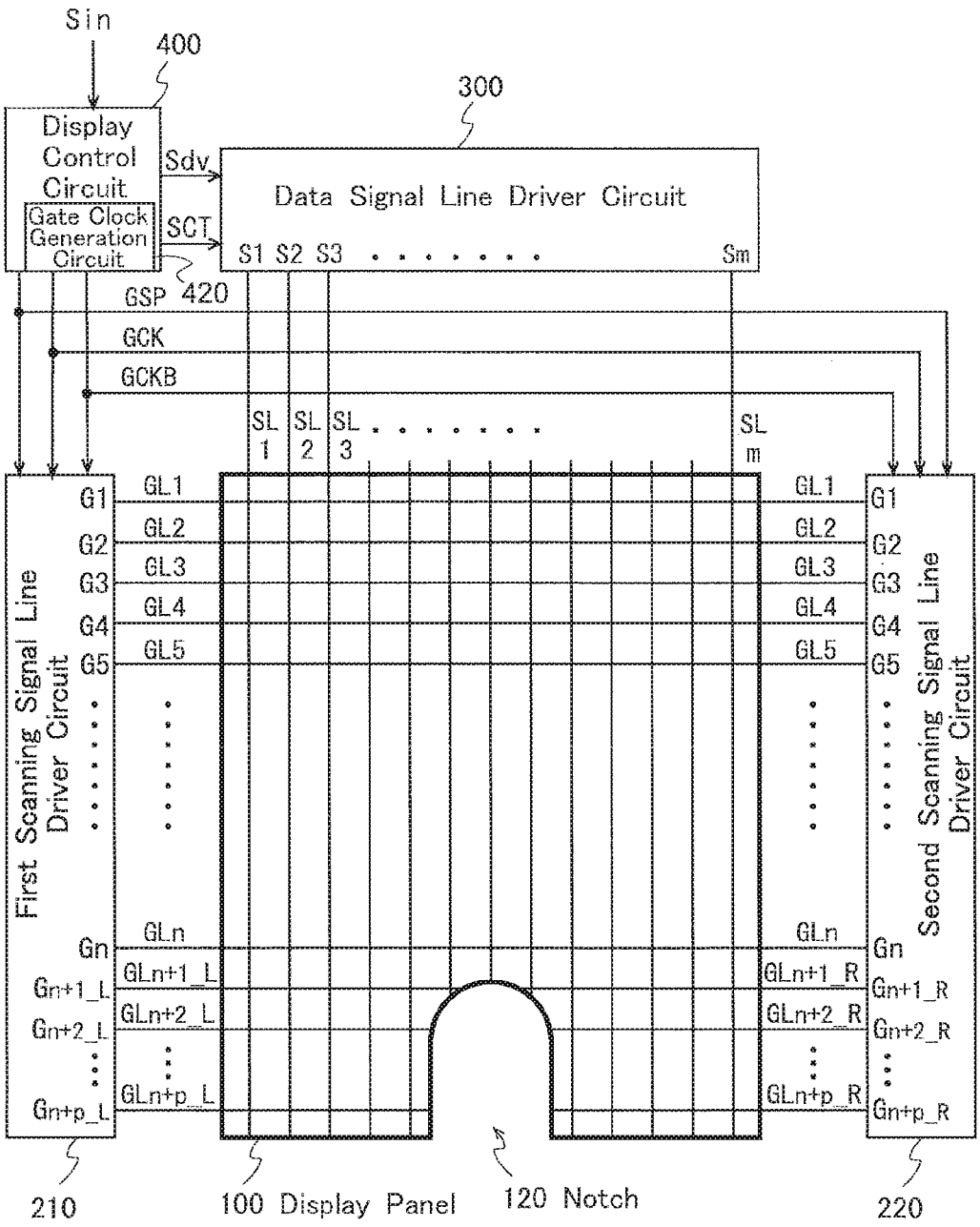
FIG. 1 is a block diagram illustrating a configuration of a liquid crystal display device according to a first embodiment.

FIG. 1 is a block diagram illustrating an overall configuration of a liquid crystal display device according to a first embodiment. This liquid crystal display device includes a display panel 100, which is an active-matrix display portion, first and second scanning signal line driver circuits (also referred to as "gate drivers") 210 and 220, a data signal line driver circuit (also referred to as a "source driver") 300, and a display control circuit 400. The display control circuit 400 is externally provided with an input signal Sin, which includes an image signal representing an image to be displayed and a timing control signal for displaying the image.

Figure 2:
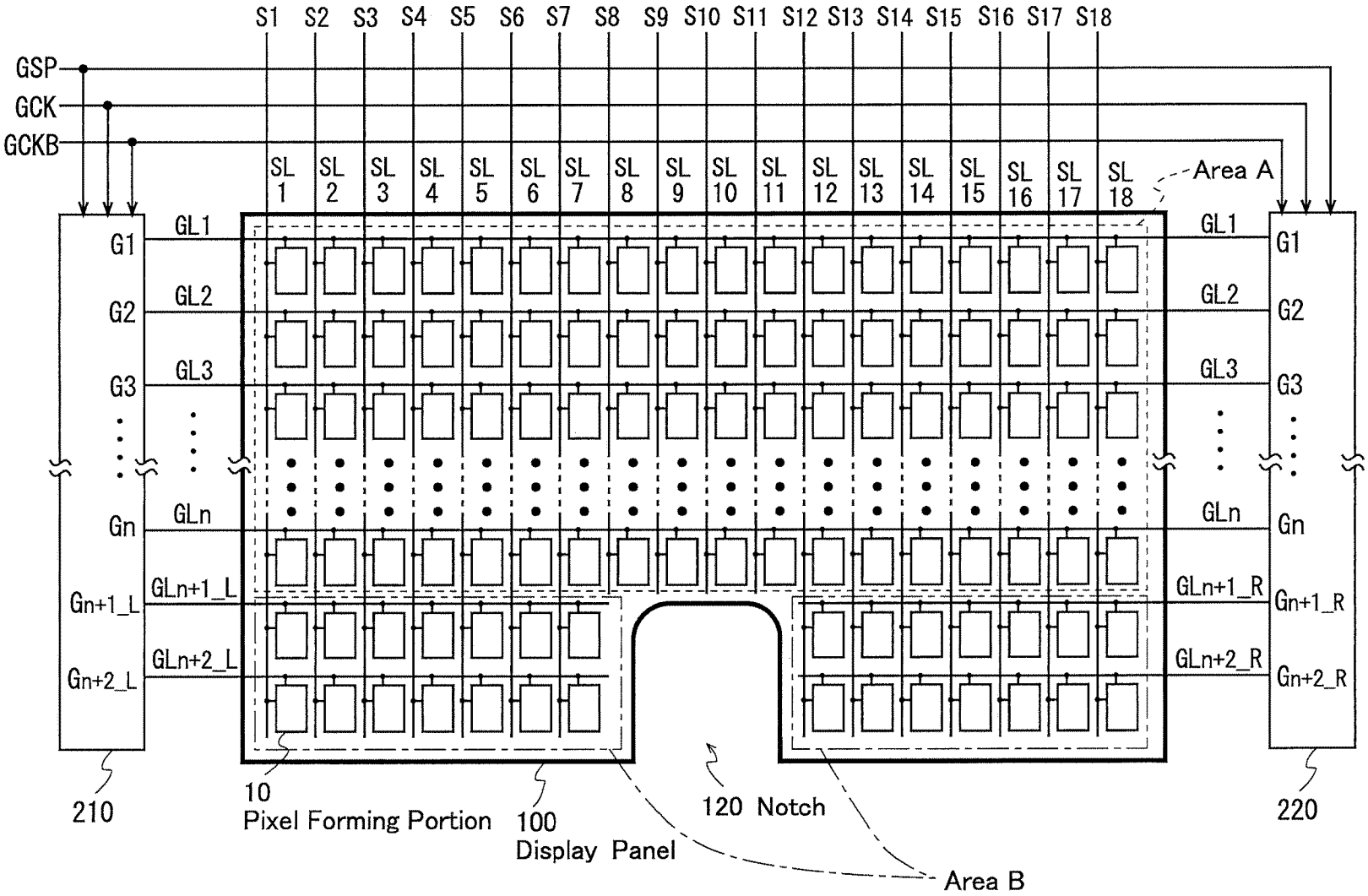
FIG. 2 is a diagram describing a configuration of a display panel in the first embodiment.

FIG. 2 is a diagram describing a configuration of the display panel 100 in the first embodiment. The display panel 100 has provided therein a plurality (m) of data signal lines (also referred to as "source lines") $SL_1$ to $SL_m$, a plurality (n+p) of scanning signal lines (also referred to as "gate lines") $GL_1$ to $GL_{n+p}$, and a plurality of pixel forming portions 10 arranged in a matrix along the data signal lines $SL_1$ to $SL_m$ and the scanning signal lines $GL_1$ to $GL_n$, as shown in FIGS. 1 and 2. Note that in FIG. 2, for convenience of illustration, the number m of data signal lines in the display panel 100 is 18, and the number p of scanning signal lines in area B of the display panel 100, which will be described later, is 2, but the number of data signal lines in the display panel 100 and the number of scanning signal lines in area B are not limited to these. The same applies to FIGS. 10 and 11.

The display panel 100 has a notch (cutout) 120 at a center of an edge in a direction in which the data signal lines $SL_j$ (where j=1 to m) extend, as shown in FIG. 1. Accordingly, each of p scanning signal lines $GL_{n+1}$ to $GL_{n+p}$, which are close to the edge and will be referred to below as "near-notch scanning signal lines" or "area-B scanning signal lines", is electrically separated into two sub-scanning signal lines by the notch 120. More specifically, each scanning signal line $GL_{n+k}$ (where k=1 to p) consists of a first sub-scanning signal line $GL_{n+_L}$ and a second sub-scanning signal line $GL_{n+k_R}$, which are electrically separated from each other. The first sub-scanning signal line $GL_{n+k_L}$ is situated to the left of the notch 120 in FIG. 1 and connected only to the first scanning signal line driver circuit 210, and the second sub-scanning signal line $GL_{n+k_R}$ is situated to the right of the notch 120 in FIG. 1 and connected only to the second scanning signal line driver circuit 220. Of the scanning signal lines $GL_1$ to $GL_{n+p}$ in the display panel 100, the scanning signal lines (referred to below as the "area-A scanning signal lines") $GL_1$ to $GL_n$, excepting the near-notch scanning signal lines (i.e., the area-B scanning signal lines), are connected to both the first and second scanning signal line driver circuits 210 and 220. Note that scanning signals $G_{n+k}$, which are respectively applied to the area-B scanning signal lines $GL_{n+k}$ in the display panel 100, include first sub-scanning signals $G_{n+k_L}$, which are applied to the first sub-scanning signal lines $GL_{n+k_L}$ by the first scanning signal line driver circuit 210, and second sub-scanning signals $G_{n+k_R}$, which are applied to the second sub-scanning signal lines $GL_{n+k_R}$ by the second scanning signal line driver circuit 220; see FIGS. 1 and 2.

Figure 3:
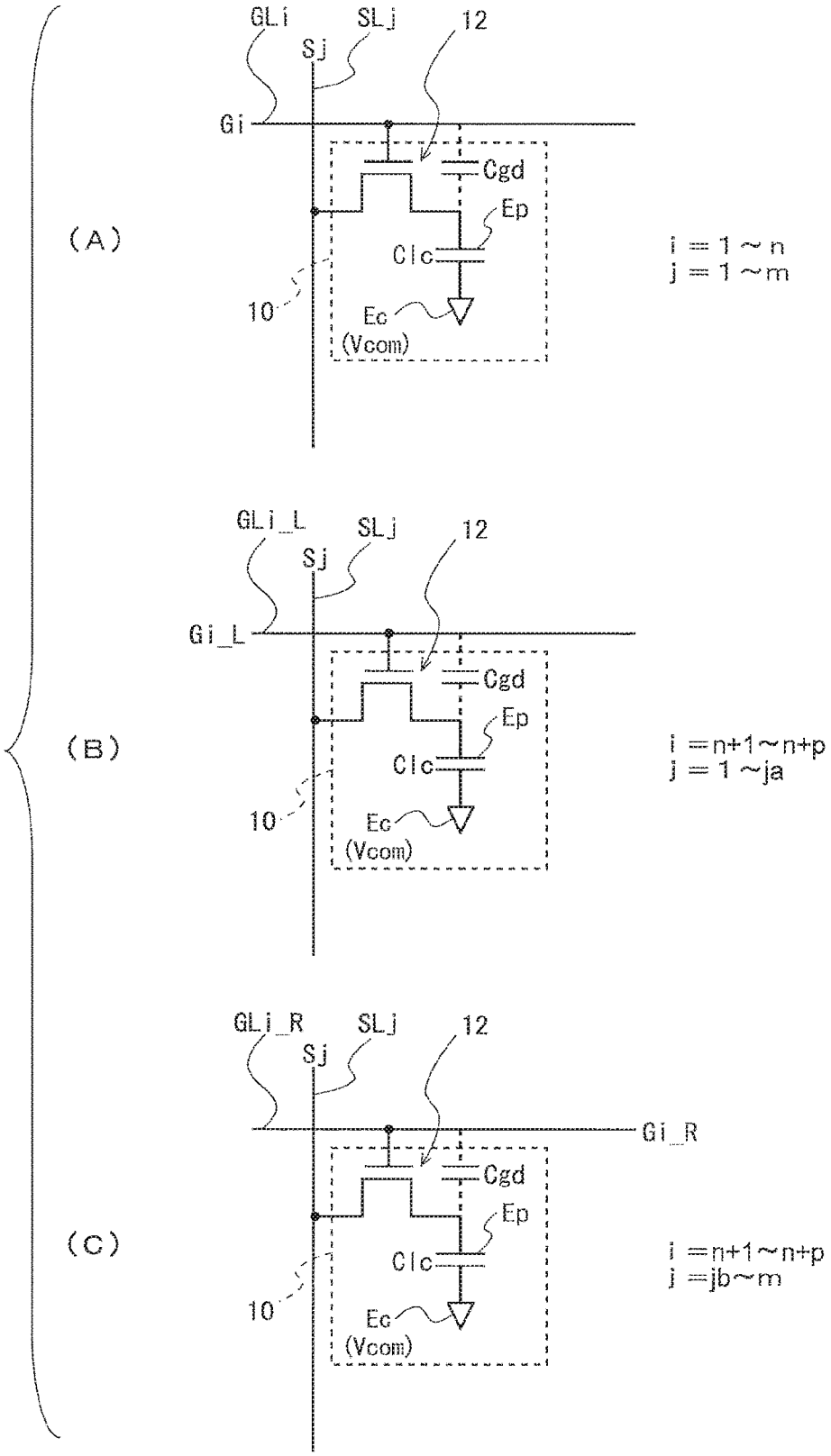
FIG. 3 provides circuit diagrams (A), (B), and (C) illustrating electrical configurations of pixel forming portions in the first embodiment.

Each pixel forming portion 10 of the display panel 100 corresponds to one of the m data signal lines $SL_1$ to $SL_m$ and also to one of the (n+p) scanning signal lines $GL_1$ to $GL_{n+p}$ (in the display panel 100 shown in FIG. 2, m=18, and p=2). FIG. 3 provides circuit diagrams illustrating electrical configurations of pixel forming portions 10 in the present embodiment; FIG. 3(A) illustrates the electrical configuration of the pixel forming portion 10 in area A (i.e., the area where the area-A scanning signal lines $GL_1$ to $GL_n$ are provided) of the display panel 100, FIG. 3(B) illustrates the electrical configuration of the pixel forming portion 10 in an area where the first sub-scanning signal lines $GL_{n+1_L}$ to $GL_{n+p_L}$ are provided (referred to below as a "first area-B portion") within area B (i.e., the area where the area-B scanning signal lines $GL_{n+1}$ to $GL_{n+p}$ are provided) of the display panel 100, and FIG. 3(C) illustrates the electrical configuration of the pixel forming portion 10 in an area where the second sub-scanning signal lines $GL_{n+1_R}$ to $GL_{n+p_R}$ are provided (referred to below as a "second area-B portion") within area B of the display panel 100. The pixel forming portions 10 shown in FIGS. 3(A) to 3(C) have the same electrical configurations, but scanning signal lines corresponding thereto are connected to different elements. More specifically, the scanning signal lines $GL_i$ (where i=1 to n) corresponding to the pixel forming portions 10 in area A are connected at one end to the first scanning signal line driver circuit 210 and at the other end to the second scanning signal line driver circuit 220, the scanning signal lines $GL_{n+k_L}$ (where k=1 to p) corresponding to the pixel forming portions 10 in the first area-B portion are connected to the first scanning signal line driver circuit 210, the scanning signal lines $GL_{n+k_R}$ (where k=1 to p) corresponding to the pixel forming portions 10 in the second area-B portion are connected to the second scanning signal line driver circuit 220. Note that each pixel forming portion 10 in area A (FIG. 3(A)) corresponds to one of the data signal lines $SL_1$ to $SL_m$, each pixel forming portion 10 in the first area-B portion (FIG. 3(B)) corresponds to one of the data signal lines $SL_1$ to $SL_{ja}$, and each pixel forming portion 10 in the second area-B portion (FIG. 3(C)) corresponds to one of the data signal lines $SL_{jb}$ to $SL_m$. Here, the data signal line $SL_{ja}$ is the closest data signal line to the notch 120 among all data signal lines that pass through the first area-B portion, and the data signal line $SL_{jb}$ is the closest data signal line to the notch 120 among all data signal lines that pass through the second area-B portion; in the display panel 100 shown in FIG. 2, m=18, ja=7, and jb=12.

As shown in FIG. 3, each pixel forming portion 10 includes a thin-film transistor (abbreviated below as a "TFT") 12, which serves as a switching element with a gate terminal connected as a control terminal to the corresponding scanning signal line $GL_i$ (where i=1 to n+p) and a source terminal connected to the corresponding data signal line $SL_j$ (where j=1 to m), a pixel electrode Ep connected as a capacitive electrode to a drain terminal of the TFT 12, a common electrode Ec provided in common for the pixel forming portions 10, and a liquid crystal layer provided in common for the pixel forming portions 10 between the pixel electrode Ep and the common electrode Ec. The pixel electrode Ep and the common electrode Ec form liquid crystal capacitance Clc, which constitutes pixel capacitance Cp as data holding capacitance. Typically, to reliably hold a voltage in the pixel capacitance Cp, an auxiliary capacitor is provided parallel to the liquid crystal capacitance Clc, but the auxiliary capacitor is not directly relevant to the present invention, and therefore any description and illustration thereof are omitted.

The TFT 12 serving as a switching element (referred to below as a "pixel switching element") in each pixel forming portion 10 is a thin-film transistor, which is a type of field-effect transistor, and therefore, parasitic capacitance Cgd, including capacitance formed by the scanning signal line $GL_i$ and the pixel electrode Ep, is present between the gate terminal and the drain terminal of the TFT 12. Note that the TFT 12 is not limited to any specific type, and for a channel layer of the TFT 12, any of the following may be used: amorphous silicon, polysilicon, microcrystalline silicon, continuous-grain silicon (CG-silicon), and an oxide semiconductor. Moreover, the mode of the liquid crystal panel serving as the display panel 100 is not limited to, for example, the VA (vertical alignment) mode, the TN (twisted nematic) mode, or the like, in which an electric field is applied vertically to a liquid crystal layer, and may be the IPS (in-plane switching) mode, in which an electric field is applied approximately parallel to a liquid crystal layer.

The display control circuit 400 externally receives an input signal Sin, and generates and outputs a digital image signal Sdv, a data control signal SCT, a scanning control signal GCT, and a common voltage Vcom (not shown) on the basis of the input signal Sin. The digital image signal Sdv and the data control signal SCT are provided to the data signal line driver circuit 300. The scanning control signal GCT includes a gate start pulse signal GSP and a two-phase clock signal consisting of a normal-phase gate clock signal GCK and a reverse-phase gate clock signal GCKB. The scanning control signal GCT is provided to the first and second scanning signal line driver circuits 210 and 220. The common voltage Vcom is provided to the common electrode Ec of the display panel 100. Note that where the normal-phase gate clock signal GCK and the reverse-phase gate clock signal GCKB do not need to be described separately below, these signals will be simply referred to as the "gate clock signals GCK and GCKB".

The display control circuit 400 includes a gate clock generation circuit 420, by which the gate clock signals GCK and GCKB are generated. Conventional gate clock generation circuits generate the gate clock signals GCK and GCKB as square-wave signals. On the other hand, the gate clock generation circuit 420 in the present embodiment is configured to generate the gate clock signals GCK and GCKB by selectively modifying waveforms of original gate clock signals generated as square waves, and in this regard, the gate clock generation circuit 420 differs from such conventional gate clock generation circuits. The gate clock generation circuit 420 will be described in detail later.

The data signal line driver circuit 300 generates m data signals $S_1$ to $S_m$ for driving the display panel 100, on the basis of the digital image signal Sdv and the data control signal SCT. More specifically, the data control signal SCT from the display control circuit 400 includes a source start pulse signal SSP, a source clock signal SCK, a latch strobe signal Ls, a polarity-switch control signal Cpn, etc. On the basis of these signals, the data signal line driver circuit 300 operates unillustrated internal components, such as a shift register and a sampling latch circuit, thereby generating m digital signals based on the digital image signal Sdv, and also converts the digital signals into analog signals through an unillustrated D/A conversion circuit, thereby generating the m data signals $S_1$ to $S_m$ as signals for driving the display panel 100. The data signals $S_1$ to $S_m$ are analog voltage signals respectively provided to the m data signal lines $SL_1$ to $SL_m$ of the display panel 100. Note that the polarity-switch control signal Cpn is a control signal for performing alternating-current drive on the display panel 100 with a view to preventing liquid crystal deterioration, and is used for switching the polarity of the data signals $S_1$ to $S_m$ at predetermined times. Note that such alternating-current drive is well-known to those skilled in the art and is not directly relevant to the features of the present invention, and therefore, any detailed description thereof will be omitted.

Figure 4:
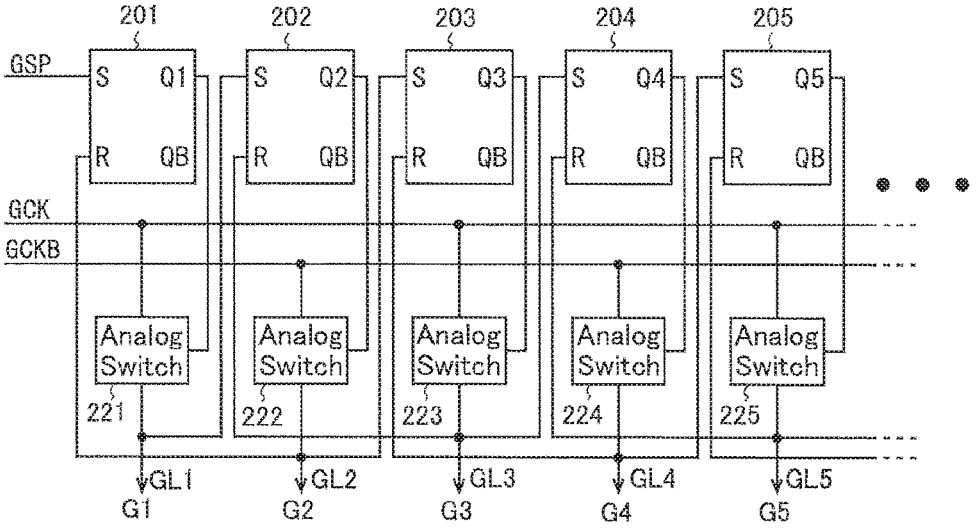
FIG. 4 is a circuit diagram illustrating a configuration of a scanning signal line driver circuit in the first embodiment.

The scanning signal line driver circuit 200 generates and applies scanning signals $G_1$ to $G_{n+p}$ respectively to the scanning signal lines $GL_1$ to $GL_{n+p}$ in accordance with the scanning control signal GCT, with the result that active scanning signals are repeatedly applied to the scanning signal lines $GL_1$ to $GL_{n+p}$ in predetermined cycles. FIG. 4 is a block diagram illustrating a configuration example of the scanning signal line driver circuit 200. The scanning signal line driver circuit 200 according to the configuration example includes (n+p+1) RS flip-flops $\mathbf{20}_1$, $\mathbf{20}_2$, $\mathbf{20}_3$, . . . , and (n+p) analog switches $\mathbf{22}_1$, $\mathbf{22}_2$, $\mathbf{22}_3$, . . . , both of which are connected as shown in FIG. 4 so as to operate as an (n+p)-stage shift register. The scanning signal line driver circuit 200 is configured to generate scanning signals $G_i$ (where i=1 to n+p) by sampling the gate clock signals GCK and GCKB through analog switches $\mathbf{22}_i$. In the (n+p)-stage shift register, the k'th stage is implemented using the k'th RS flip-flop $\mathbf{20}_k$ and the k'th analog switch $\mathbf{22}k$. More specifically, the first RS flip-flop 201 receives a gate start pulse signal GSP at a set terminal (S-terminal) from the display control portion 400 and also receives a scanning signal $G_2$ at a reset terminal (R-terminal) as an output of the second analog switch $\mathbf{22}_2$. The i'th (where i=2 to n+p) RS flip-flop $\mathbf{20}_i$ receives a scanning signal at a set terminal as an output of the (i−1)'th analog switch $\mathbf{22}_{i-1}$ and a scanning signal $G_{i+1}$ at a reset terminal as an output of the (i+1)'th analog switch $\mathbf{22}_{i+1}$. The (n+p)'th RS flip-flop $\mathbf{20}_{n+p}$ corresponding to the last stage receives a scanning signal $G_{n+p-1}$ at a set terminal as an output of the (n+p−1)'th analog switch $\mathbf{22}_{n+p-1}$ and an output signal from the (n+p+1)'th analog switch $\mathbf{22}_{n+p+1}$ at a reset terminal.

Furthermore, in the scanning signal line driver circuit 200, the normal-phase gate clock signal GCK from the display control circuit 400 is inputted to the odd-numbered analog switches $\mathbf{22}_1$, $\mathbf{22}_3$, $\mathbf{22}_5$, . . . , and the reverse-phase gate clock signal GCKB from the display control circuit 400 is inputted to the even-numbered analog switches $\mathbf{22}_2$, $\mathbf{22}_4$, $\mathbf{22}_6$, . . . . Each analog switch $\mathbf{22}_i$ receives an output signal $Q_i$ of the RS flip-flop $\mathbf{20}_i$ that corresponds to (i.e., the RS flip-flop that is in the same stage as) that analog switch $\mathbf{22}_i$ as a control signal (where i=1 to n+p). As a result, the i'th analog switch $\mathbf{22}_i$ is rendered in ON-state when the output signal $Q_i$ of the i'th-stage RS flip-flop $\mathbf{20}_i$ is at high level (H-level) and rendered in OFF-state when the output signal $Q_i$ is at low level (L-level). Therefore, while the output signal $Q_i$ of any odd-numbered-stage RS flip-flop $\mathbf{20}_i$ is at H-level (where i=1, 3, 5, . . . ), the normal-phase gate clock signal GCK is applied to each scanning signal line $GL_i$ as a scanning signal $G_i$, and while the output signal $Q_i$ of any even-numbered-stage RS flip-flop $\mathbf{20}_i$ is at H-level (where i=2, 4, 6, . . . ), the reverse-phase gate clock signal GCKB is applied to each scanning signal line $GL_i$ as a scanning signal $G_i$.

Provided on a back side of the display panel 100 is an unillustrated backlight unit, by which the display panel 100 is backlighted. The backlight unit is also driven by the display control circuit 400 but may be configured to be driven by another method. Note that when the display panel 100 is of a reflective type, the backlight unit is dispensable.

As described above, the data signals $S_1$ to $S_m$ are respectively applied to the data signal lines $SL_1$ to $SL_m$, the scanning signals $G_1$ to $G_{n+p}$ are respectively applied to the scanning signal lines $GL_1$ to $GL_{n+p}$, and the display panel 100 is backlighted, with the result that the display panel 100 displays the image represented by the externally provided input signal Sin.

It should be noted that in the configuration as shown in FIGS. 1 to 4, either the data signal line driver circuit 300 or the scanning signal line driver circuits 210 and 220, or both, may be provided in the display control circuit 400. Moreover, either the data signal line driver circuit 300 or the scanning signal line driver circuits 210 and 220, or both, may be integrally formed with the display panel 100.

1.2 Problems with Conventional Liquid Crystal Display Device

Figure 5:
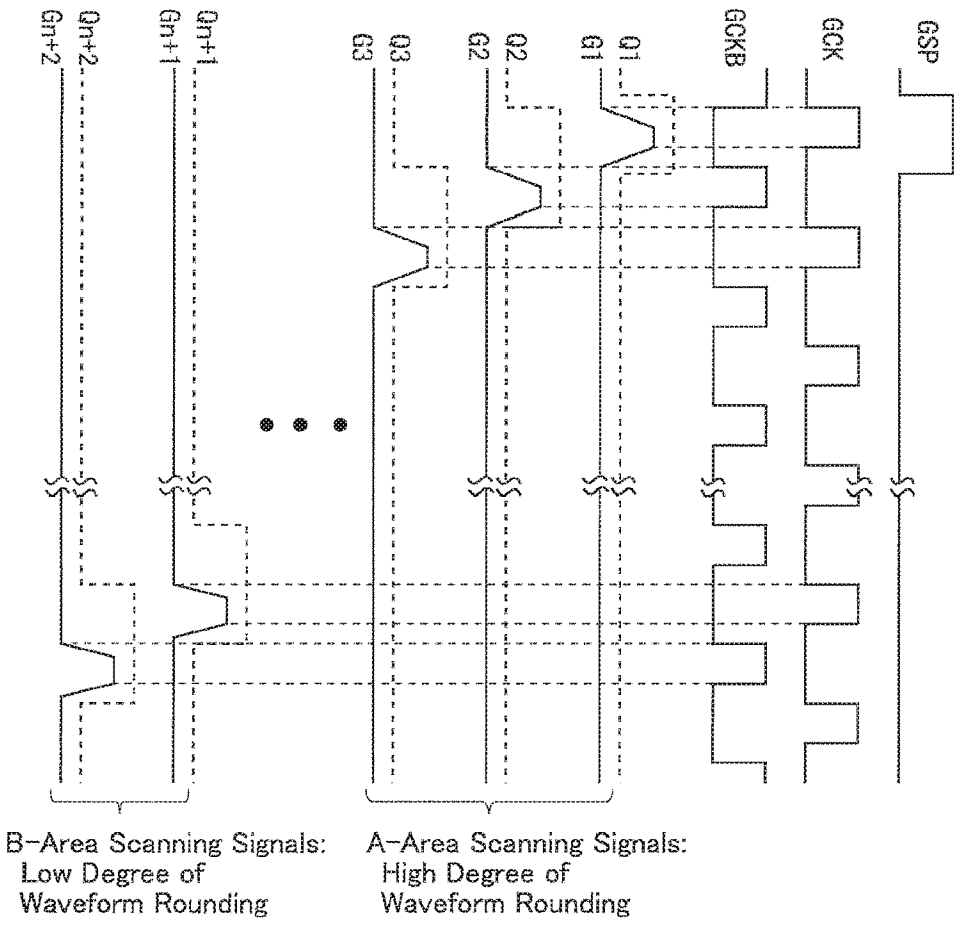
FIG. 5 PRIOR ART
FIG. 5 is a signal waveform chart describing problems with a conventional liquid crystal display device.

FIG. 5 is a signal waveform chart describing problems with a conventional liquid crystal display device where the display panel 100 has a notch as shown in FIG. 1 or 2. As in the first embodiment, this conventional liquid crystal display device includes scanning signal driver circuits configured as shown in FIG. 4. In the conventional liquid crystal display device, the scanning signal driver circuits configured as shown in FIG. 4 receive a gate start pulse signal GSP and gate clock signals GCK and GCKB, all of which are shown in FIG. 5. Each of the signals GSP, GCK, and GCKB includes rectangular pulses whose fall time and rise time are sufficiently short for widths thereof.

When the gate start pulse signal GSP and the gate clock signals GCK and GCKB, all of which are shown in FIG. 5, are inputted to the first scanning signal line driver circuit 210 and the second scanning signal line driver circuit 220, which are respectively connected to opposite ends of the scanning signal lines $GL_1$ to $GL_{n+p}$ (where p=2) of the display panel 100 shaped as shown in FIG. 2, the RS flip-flop $\mathbf{20}_1$ to $\mathbf{20}_{n+2}$ in respective stages generate output signals $Q_1$ to $Q_{n+2}$ as shown in FIG. 5. On the basis of the output signals $Q_1$ to $Q_{n+2}$, scanning signals $G_1$ to $G_{n+2}$ as shown in FIG. 5 are generated. Each scanning signal line $GL_1$ has capacitance and resistance, and therefore, even if the gate clock signals GCK and GCKB are pulse signals free from waveform rounding, the scanning signal $G_i$ has a waveform rounded in accordance with the length of the scanning signal line $GL_i$ to which the scanning signal $G_i$ is applied. More specifically, the waveform of the scanning signal $G_i$ is rounded in accordance with a time constant determined by the capacitance and the resistance of the scanning signal line $GL_i$ to which the scanning signal $G_i$ is applied. As can be appreciated from FIG. 2, the scanning signal lines $GL_1$ to $GL_n$ provided in area A of the display panel 100 have a relatively large time constant, and the scanning signal lines $GL_{n+1}$ to $GL_{n+2}$ provided in area B have a relatively small time constant. Accordingly, the scanning signals $G_{n+1}$ and $G_{n+2}$ applied to the scanning signal lines $GL_{n+1}$ and $GL_{n+2}$ in area B have waveforms rounded to a lesser degree than are waveforms of the scanning signals $G_1$ to $G_n$ applied to the scanning signal lines $GL_1$ to $GL_n$ in area A, as shown in FIG. 5.

A pixel voltage Vp (i.e., a voltage of the pixel electrode Ep) of each pixel forming portion 10 is reduced by a predetermined amount (referred to below as a "pixel voltage reduction amount ΔVp") owing to parasitic capacitance Cgd when a voltage of the scanning signal line $GL_i$ connected to the gate terminal of the TFT 12 serving as a pixel switching element in the pixel forming portion 10 (i.e., a voltage of the scanning signal $G_i$) changes from an on-voltage, which renders the TFT 12 in ON-state, to an off-voltage, which renders the TFT 12 in OFF-state; see FIG. 3. In the present embodiment, since the TFT 12 is an N-ch transistor, as shown in FIG. 3, the on-voltage is equivalent to a voltage of an H-level scanning signal, i.e., an H-level gate voltage Vgh, and the off-voltage is equivalent to a voltage of an L-level scanning signal, i.e., an L-level gate voltage Vgl. Accordingly, assuming that the voltage of the scanning signal $G_i$ changes instantly from the on-voltage (i.e., the H-level gate voltage Vgh) to the off-voltage (i.e., the L-level gate voltage Vgl), i.e., assuming that such a change occurs in an ideal manner, the pixel voltage reduction amount ΔVp is expressed by the following equation.

$$\Delta Vp=\{Cgd/(Clc+Cgd)\}(Vgh-Vgl) \quad (2)$$

Equation (2) can be derived from the law of charge conservation for the pixel electrode Ep (strictly, a node including the pixel electrode Ep). Specifically, immediately prior to the TFT 12 in the pixel forming portion 10 changing from ON-state to OFF-state, the pixel voltage Vp is equal to a voltage Vs of the data signal $S_j$, and an amount of electric charge $Q_{on}$ of the pixel electrode Ep is such that:

$$Q_{on}=Cgd(Vp-Vgh)+Clc(Vp-Vcom);$$

a charge amount $Q_{off}$ of the pixel electrode Ep immediately after the change of the TFT 12 from ON-state to OFF-state is such that:

$$Q_{off}=Cgd(Vp-\Delta vp-Vgl)+Clc(Vp-\Delta Vp-Vcom),$$

and therefore, from $Q_{on}=Q_{off}$, which express the law of charge conservation, $$Cgd(Vp-Vgh)+Clc(Vp-Vcom)=Cgd(Vp-\Delta Vp-Vgl)+Clc(Vp-\Delta Vp-Vcom).$$

By solving this formula for ΔVp, equation (2) is obtained.

However, as has already been described, each scanning signal line $GL_i$ has capacitance and resistance, and therefore, each scanning signal $G_i$ has a waveform rounded in accordance with the time constant of the scanning signal line $GL_i$ to which the scanning signal $G_i$ is applied. Accordingly, when the TFT 12 is turned off, the scanning signal $G_i$ does not change instantly from the H-level gate voltage Vgh, i.e., the on-voltage, to the L-level gate voltage Vgl, i.e., the off-voltage, an electric charge flows from the data signal line $SL_j$ to the pixel electrode Ep via the TFT 12 during a period of the change from the on-voltage to the off-voltage (referred to below as an "on-to-off transition period"). As a result, when compared to the case where the pixel voltage reduction amount ΔVp (>0) is ideal, the pixel voltage reduction amount ΔVp becomes lower in accordance with the degree to which the falling waveform of the scanning signal $G_i$ is rounded. That is, the pixel voltage reduction amount ΔVp decreases as the degree to which the falling waveform of the scanning signal $G_i$ is rounded increases with the time constant of the scanning signal line $GL_i$.

Accordingly, in the case of the conventional liquid crystal display device including the display panel 100 configured as shown in FIG. 2, the scanning signals $G_{n+1}$ and $G_{n+2}$ applied to the area-B scanning signal lines $GL_{n+1}$ and $GL_{n+2}$ have waveforms rounded to a lesser degree than are waveforms of the scanning signals $G_1$ to $G_n$ applied to the area-A scanning signal lines $GL_1$ to $GL_n$ (i.e., the on-to-off transition period is shorter for the scanning signals $G_{n+1}$ and $G_{n+2}$), as shown in FIG. 5. Therefore, the pixel voltage reduction amount ΔVp (>0) is larger for the pixel forming portions 10 connected to the area-B scanning signal lines $GL_{n+1}$ and $GL_{n+2}$ than for the pixel forming portions 10 connected to the area-A scanning signal lines $GL_1$ to $GL_n$.

Figure 6:
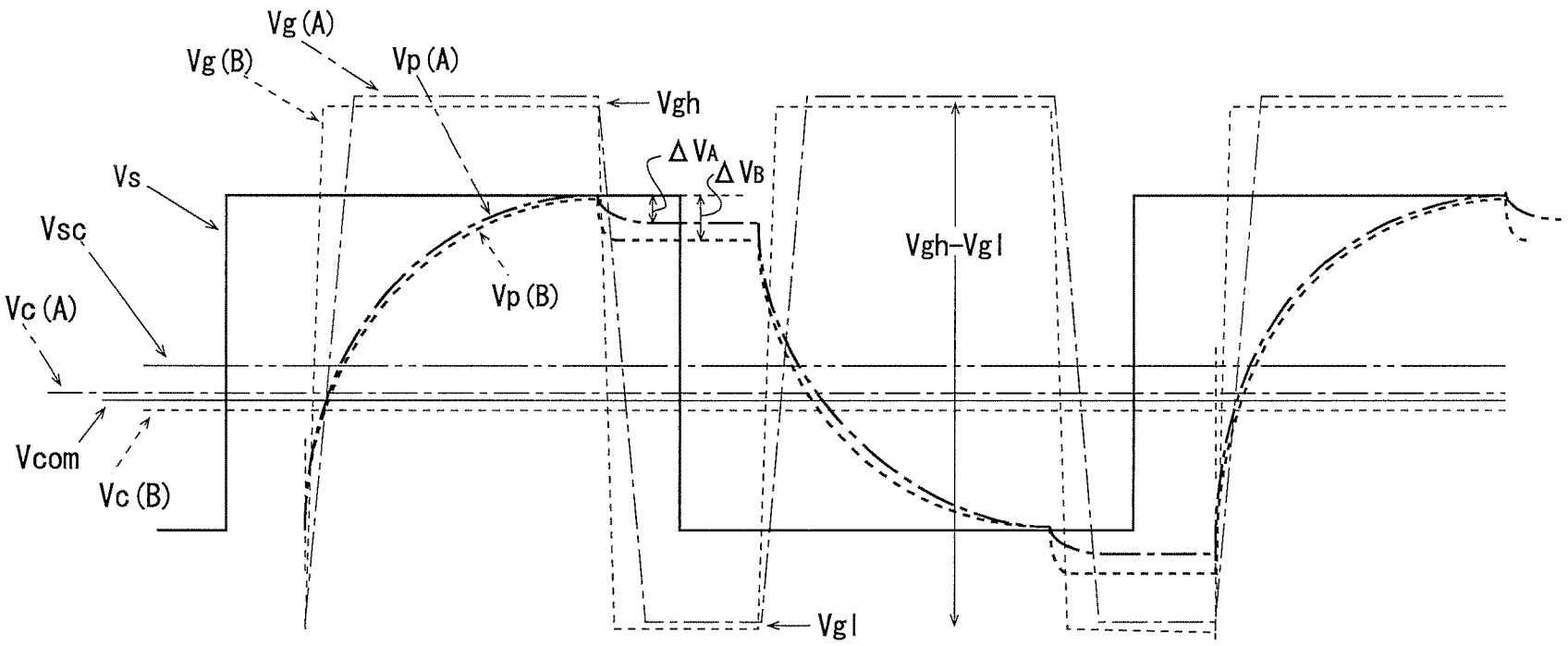
FIG. 6 PRIOR ART
FIG. 6 is a signal waveform chart describing a mechanism causing the problems with the conventional liquid crystal display device.

FIG. 6 is a signal waveform chart describing in more detail the above-described phenomenon of the conventional liquid crystal display device; focusing on one of the pixel forming portions 10 connected to the area-A scanning signal lines $GL_1$ to $GL_n$ (referred to below as the "area-A pixel forming portions") and one of the pixel forming portions 10 connected to the area-B scanning signal lines $GL_{n+1}$ and $GL_{n+2}$ (referred to below as the "area-B pixel forming portions"), the chart shows voltage waveforms for some signals and some parts of the area-A pixel forming portion and the area-B pixel forming portion. Note that these voltage waveforms are depicted for convenience of describing the above phenomenon and therefore do not necessarily match the waveforms that are actually used in driving the liquid crystal display device.

In FIG. 6, the waveform depicted with the thick line represents a voltage Vs of the data signal $S_j$, the waveform depicted with the thin long-dashed short-dashed line represents a voltage Vg(A) of the area-A scanning signal line $GL_i$ (referred to below as an "area-A scanning voltage"), the waveform depicted with the thin dotted line represents a voltage Vg(B) of the area-B scanning signal line $GL_{n+k}$ (referred to below as an "area-B scanning voltage"), the waveform depicted with the thick long-dashed short-dashed line represents a pixel voltage Vp(A) of the area-A pixel forming portion, the waveform depicted with the thick dotted line represents a pixel voltage Vp(B) of the area-B pixel forming portion, the thin straight line represents a common voltage Vcom, the thin long-dashed double-short-dashed straight line represents a center voltage Vsc of the data signal $S_j$, the thin long-dashed short-dashed straight line represents a center pixel voltage Vc(A) of the area-A pixel forming portion (referred to below as an "area-A pixel center voltage"), and the thin dotted straight line represents a center pixel voltage Vc(B) of the area-B pixel forming portion (referred to below as an "area-B pixel center voltage").

The waveform of the area-B scanning voltage Vg(B) is rounded to a lesser degree than the waveform of the area-A scanning voltage Vg(A), as shown in FIG. 6, and therefore, the area-B scanning voltage Vg(B) has a shorter fall time (i.e., a time period equivalent to the on-to-off transition period) than the area-A scanning voltage Vg(A). Accordingly, a reduction amount $\Delta V_B$ for the pixel voltage Vp(B) of the area-B pixel forming portion during the on-to-off transition period (the reduction amount will be referred to below as the "area-B pixel voltage reduction amount $\Delta V_B$") is greater than a reduction amount $\Delta V_A$ for the pixel voltage Vp(A) of the area-A pixel forming portion during the on-to-off transition period (the reduction amount will be referred to below as the "area-A pixel voltage reduction amount $\Delta V_A$"). Consequently, the area-B pixel center voltage Vc(B) becomes less than the area-A pixel center voltage Vc(A), and a lower effective voltage is applied to the liquid crystal capacitance Clc in the area-B pixel forming portion than to the liquid crystal capacitance Clc in the area-A pixel forming portion. Therefore, even for the same voltage Vs of the data signal, there is a difference in luminance between an image display area formed by the area-B pixel forming portions (referred to below as a "B-display area") and an image display area formed by the area-A pixel forming portions (referred to below as an "A-display area"). As a result, the conventional liquid crystal display device with the display panel 100 configured as shown in FIG. 2 fails to provide satisfactory image display free from display irregularities.

1.3 Gate Clock Generation Circuit in the First Embodiment

Figure 7:
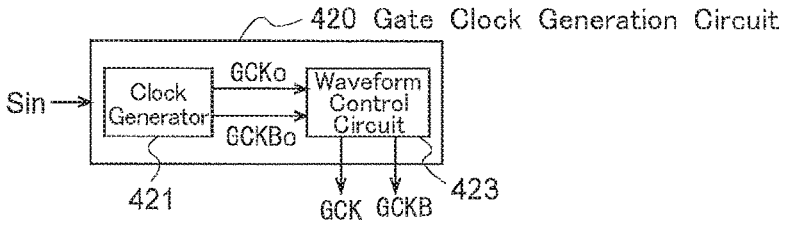
FIG. 7 is a block diagram illustrating a configuration of a gate clock generation circuit in the first embodiment.

FIG. 7 is a block diagram illustrating the configuration of the gate clock generation circuit 420 in the present embodiment. The gate clock generation circuit 420 includes a clock generator 421 and a waveform control circuit 423. The clock generator 421 generates a normal-phase original gate clock signal GCKo and a reverse-phase original gate clock signal GCKBo as square-wave signals, and the waveform control circuit 423 modifies rectangular pulses included in the normal-phase and reverse-phase original gate clock signals GCKo and GCKBo, as shown in FIG. 8, thereby generating the above-described gate clock signals GCK and GCKB.

Figure 8:
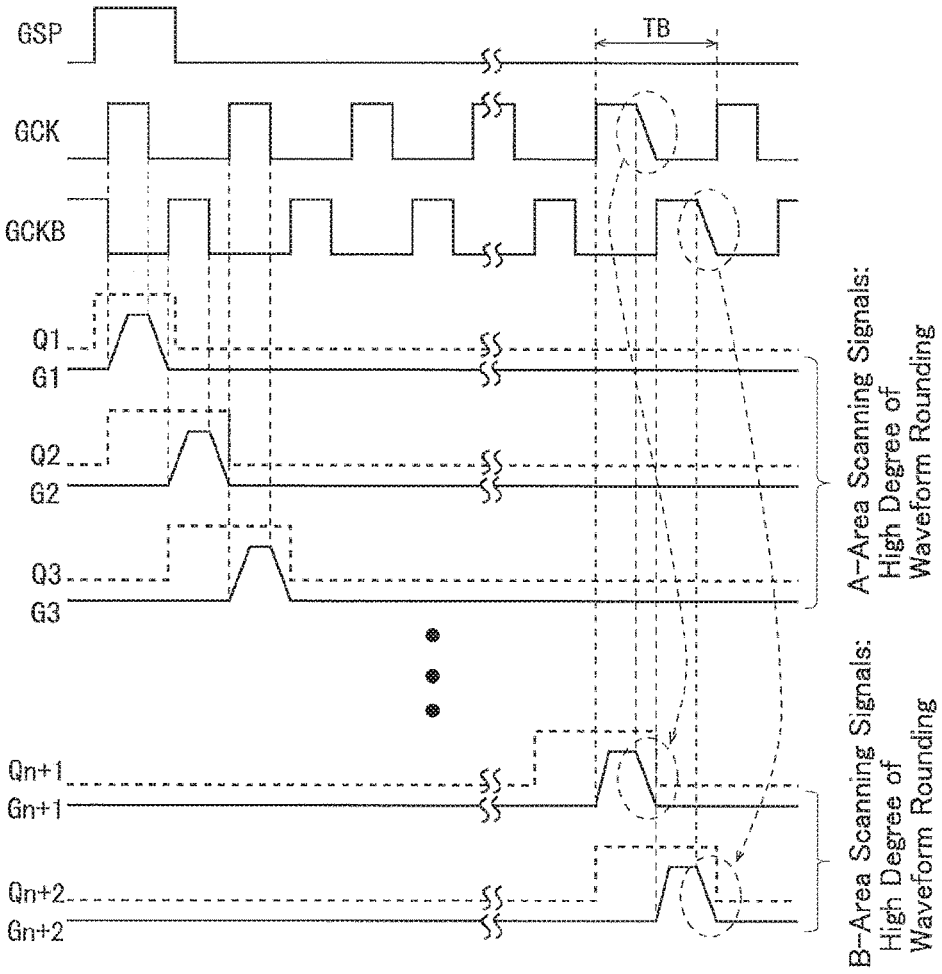
FIG. 8 is a signal waveform chart describing operational advantages of the first embodiment.

FIG. 8 is a signal waveform chart describing operational advantages of the present embodiment. In the present embodiment, the gate clock generation circuit 420 outputs a gate start pulse signal GSP including one pulse per frame period, and also outputs gate clock signals GCK and GCKB with selectively modified waveforms as shown in FIG. 8. More specifically, of the rectangular pulses (referred to below as the "original clock pulses") included in the normal-phase and reverse-phase original gate clock signals GCKo and GCKBo, the waveform control circuit 423 of the gate clock generation circuit 420 rounds only the rectangular pulses that correspond to the scanning signals $G_{n+1}$ to $G_{n+p}$ applied to the area-B scanning signal lines $GL_{n+1}$ to $GL_{n+p}$ (in the display panel 100 shown in FIG. 3, p=2), thereby generating the gate clock signals GCK and GCKB as shown in FIG. 8. As can be appreciated from the configuration of the scanning signal line driver circuits 210 and 220 shown in FIG. 4, the waveform control circuit 423 rounds falling waveforms of the original clock pulses during a period TB in which the pulses of the gate clock signals GCK and GCKB that correspond to the scanning signals $G_{n+1}$ to $G_{n+p}$ to be applied to the area-B scanning signal lines $GL_{n+1}$ to $GL_{n+p}$ occur (the period will be referred to below as the "area-B period"), with the result that the duration of the on-to-off transition period is increased at the fall of the original clock pulses during the area-B period TB. The degree to which the waveforms of the original clock pulses are rounded during the area-B period is set on the basis of the difference in time constant between the area-A scanning signal lines $GL_i$ (where i=1 to n) and the area-B scanning signal lines $GL_{n+k}$ (where k=1 to p), such that the area-B pixel voltage reduction amount $\Delta V_B$ shown in FIG. 6 is approximately equal to the area-A pixel voltage reduction amount $\Delta V_A$.

The waveform control circuit 423 performs the above-described selective modification, i.e., rounding of at least the falling waveforms thereby to lengthen the fall time, as shown in FIG. 8, on the rectangular pulses included in the normal-phase and reverse-phase original gate clock signals GCKo and GCKBo, with the result that the scanning signals $G_{n+1}$ to $G_{n+p}$ applied to the area-B scanning signal lines $GL_{n+1}$ to $GL_{n+p}$ become approximately equal to the scanning signals $G_1$ to $G_n$ applied to the area-A scanning signal lines $GL_1$ to $G_n$ in terms of the degree to which the falling waveforms are rounded (i.e., in terms of the fall time); see the scanning signals $G_1$ to $G_{n+2}$ shown in FIG. 8.

1.4 Effects

In the present embodiment as described above, even when the display panel 100 has the notch 120 as shown in FIGS. 1 and 2, by controlling the waveforms of the gate clock signals GCK and GCKB as shown in FIG. 8 on the premise that the scanning signal line driver circuits are configured as shown in FIG. 4, all of the scanning signals $G_1$ to $G_{n+p}$ applied to the scanning signal lines $GL_1$ to $GL_{n+p}$ of the display panel 100 are rendered approximately equal in terms of the degree of waveform rounding (i.e., the duration of the on-to-off transition period at the fall), whereby in any pixel forming portion 10 (either the area-A pixel forming portion or the area-B pixel forming portion), the pixel voltage reduction amount ΔVp (either the area-A pixel voltage reduction amount $\Delta V_A$ or the area-B pixel voltage reduction amount $\Delta V_B$) is rendered approximately equal. Accordingly, in any pixel forming portion 10, if the voltage Vs of the data signal $S_j$ is the same, the effective voltage applied to the liquid crystal capacitance Clc is also the same. Thus, it is possible to provide satisfactory image display free from display irregularities by inhibiting a luminance difference from occurring due to the difference in time constant of the scanning signal line $GL_i$ between the A-display area and the B-display area, while preventing an increased circuit scale and a more complex circuit configuration.

1.5 Variants

Figure 9:
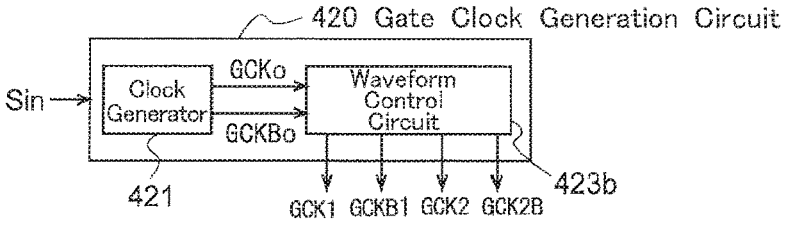
FIG. 9 is a block diagram illustrating a configuration of a gate clock generation circuit in a variant of the first embodiment.
Figure 10:
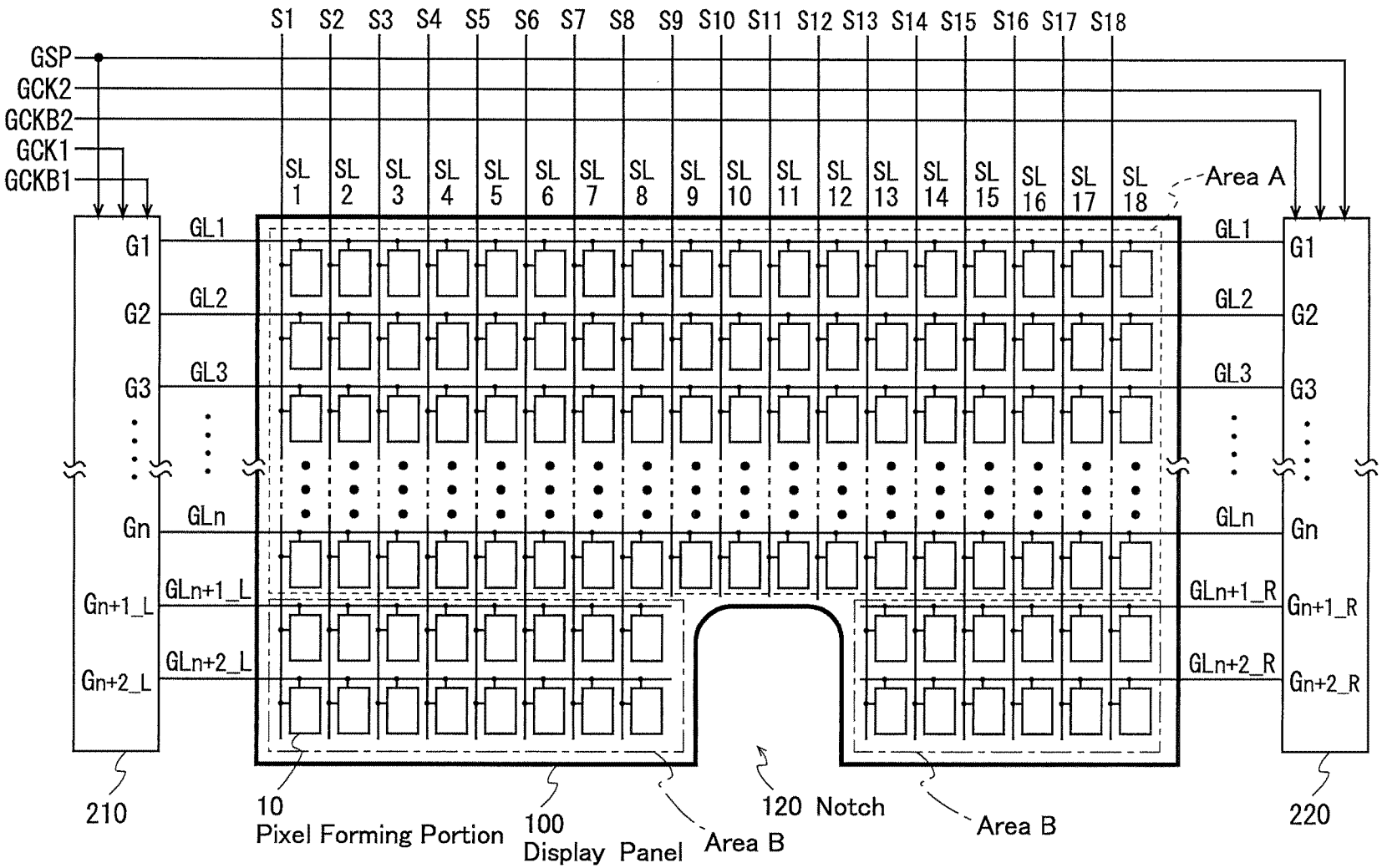
FIG. 10 is a diagram describing a configuration of a liquid crystal display device according to the variant of the first embodiment.

In the first embodiment, the first sub-scanning signal line $GL_{n+k_L}$ and the second sub-scanning signal line $GL_{n+k_R}$ in area B of the display panel 100 are equal in length and time constant, and correspondingly, the scanning signal $G_{n+k_L}$ applied to the first sub-scanning signal line $GL_{n+k_L}$ and the scanning signal $G_{n+k_R}$ applied to the second sub-scanning signal line $GL_{n+k_R}$ are signals $G_{n+k}$ having the same waveform. However, the first sub-scanning signal line $GL_{n+k_L}$ and the second sub-scanning signal line $GL_{n+k_R}$ in area B may differ in both length and time constant. In such a case, in place of the waveform control circuit shown in FIG. 7, a waveform control circuit 423*b* shown in FIG. 9 may be used, so that on the basis of the difference in time constant between the area-A scanning signal line $GL_i$ (where i=1 to n) and the first sub-scanning signal line $GL_{n+k_L}$ (where k=1 to p) in area B (i.e., the difference in capacitance Cgl and resistance Rgl due to the difference in signal line length), the waveform control circuit 423*b* generates first normal-phase and reverse-phase gate clock signals GCK1 and GCKB1 by rounding falling waveforms of original clock pulses during the area-B period TB so as to approximately equalize the area-B pixel voltage reduction amount $\Delta V_B$ with the area-A pixel voltage reduction amount $\Delta V_A$, and further, on the basis of the difference in time constant between the area-A scanning signal line $GL_i$ (where i=1 to n) and the second sub-scanning signal line $GL_{n+k_R}$ (where k=1 to p) in area B, the waveform control circuit 423*b* generates second normal-phase and reverse-phase gate clock signals GCK2 and GCKB2 by rounding falling waveforms of original clock pulses during the area-B period TB so as to approximately equalize the area-B pixel voltage reduction amount $\Delta V_B$ with the area-A pixel voltage reduction amount $\Delta V_A$. In such a case, as shown in FIG. 10, the first normal-phase and reverse-phase gate clock signals GCK1 and GCKB1 are inputted to the first scanning signal line driver circuit 210, and the second normal-phase and reverse-phase gate clock signals GCK2 and GCKB2 are inputted to the second scanning signal line driver circuit 220. This configuration renders it possible to achieve effects similar to those achieved by the first embodiment. Note that in this configuration, when the first sub-scanning signal line $GL_{n+k_L}$ is longer than the second sub-scanning signal line $GL_{n+k_R}$ (more precisely, the time constant that corresponds to the length of the first sub-scanning signal line $GL_{n+k_L}$ is greater than the time constant that corresponds to the length of the second sub-scanning signal line $GL_{n+k_R}$), the degree to which the waveform control circuit 423*b* rounds the original clock pulses during the area-B period TB is larger when the second normal-phase and reverse-phase gate clock signals GCK2 and GCKB2 are generated than when the first normal-phase and reverse-phase gate clock signals GCK1 and GCKB1 are generated.

In the first embodiment, the area-B scanning signal lines $GL_{n+1}$ to $GL_{n+p}$ have the same length and hence the same time constant (i.e., the same capacitance Cgl and the same resistance Rgl). However, even if the area-B scanning signal lines $GL_{n+1}$ to $GL_{n+p}$ have different lengths (and time constants), the waveform control circuit rounds original clock pulses that correspond to scanning signals $G_{n+k}$ (where k=1 to p) to be applied to the area-B scanning signal lines $GL_{n+k}$ in accordance with time constants of the area-B scanning signal lines $GL_{n+k}$, thereby equalizing the pixel voltage reduction amount $\Delta Vp$ among all pixel forming portions 10 of the display panel 100. Accordingly, even in the above case, effects similar to those achieved by the first embodiment can be achieved.

In the first embodiment, the waveform control circuit 423, which rounds the original clock pulses in order to equalize the pixel voltage reduction amount $\Delta Vp$, is provided in the display control circuit 400 (see FIGS. 1 and 7). Instead of this, a circuit that corresponds to the waveform control circuit 423 may be provided in the scanning signal line driver circuit (in the first embodiment, each of the first and second scanning signal line driver circuits 210 and 220), or such a circuit may be provided between the display control circuit 400 and the scanning signal line driver circuit.

2. Second Embodiment

Next, an example of the liquid crystal display device in which the circuit that corresponds to the waveform control circuit 423 in the first embodiment is provided between the display control circuit and the scanning signal line driver circuit will be described as a second embodiment. The present embodiment differs from the first embodiment in the configuration that rounds the original clock pulses in order to equalize the pixel voltage reduction amount $\Delta Vp$, but since other configurations are the same as in the first embodiment, the same or corresponding components are denoted by the same reference characters, and any detailed descriptions thereof will be omitted.

Figure 11:
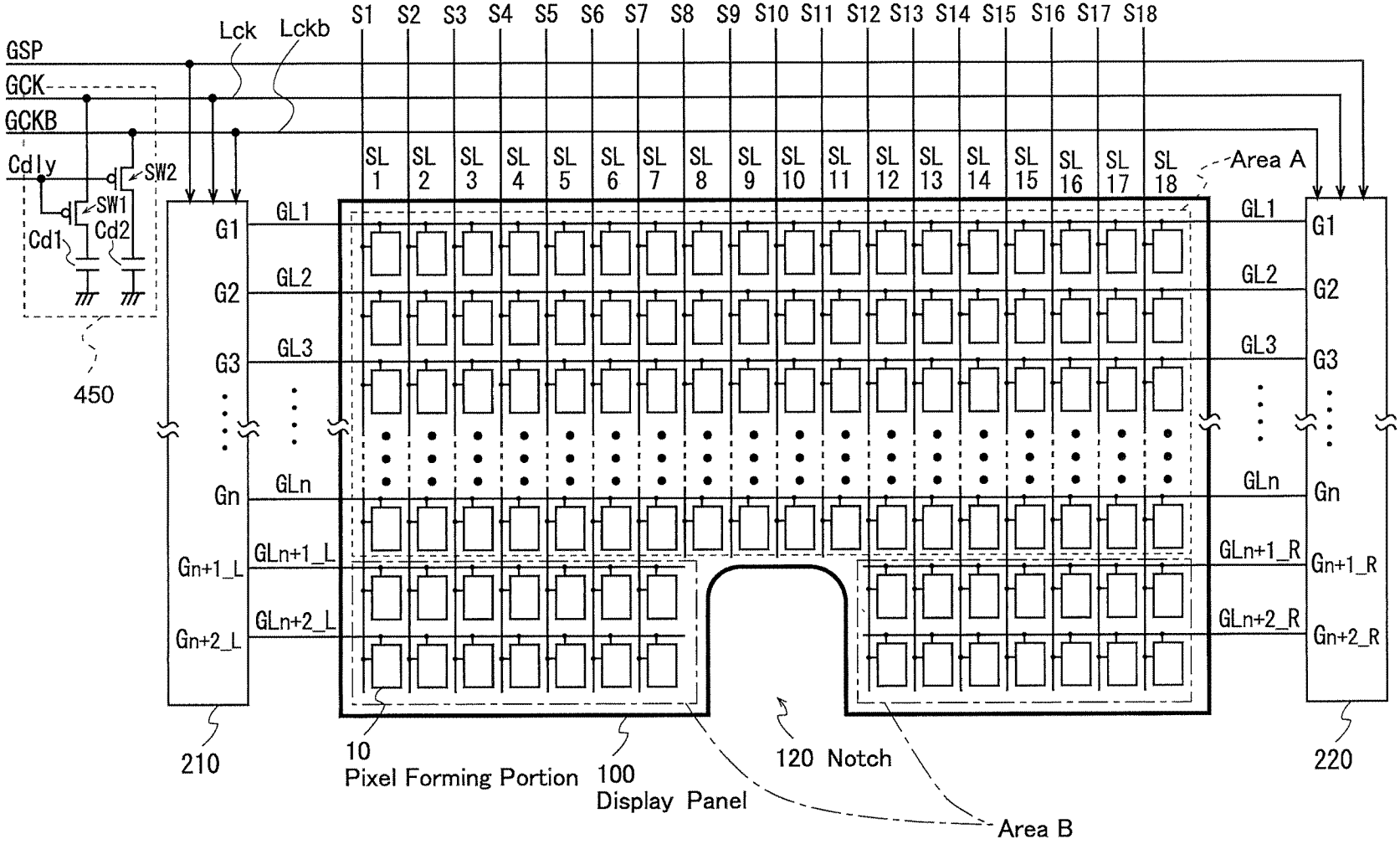
FIG. 11 is a diagram describing a configuration of a liquid crystal display device according to a second embodiment.

FIG. 11 is a diagram describing the configuration of the liquid crystal display device according to the present embodiment. In the present embodiment, as in the first embodiment, the display panel 100 is an active-matrix display panel and has the notch 120, as shown in FIG. 11. However, in the embodiment, unlike in the first embodiment, the gate clock generation circuit 420 in the display control circuit 400 does not include the waveform control circuit 423, and internally generates normal-phase and reverse-phase original gate clock signals GCKo and GCKBo, which are outputted as normal-phase and reverse-phase gate clock signals GCK and GCKB without modification. As in the first embodiment (see FIG. 1), the normal-phase and reverse-phase gate clock signals GCK and GCKB are inputted to the first and second scanning signal line driver circuits 210 and 220 via clock-transmission signal lines Lck and Lckb provided between the display control circuit 400 and the first and second scanning signal line driver circuits 210 and 220.

In the present embodiment, unlike in the first embodiment, there is provided a waveform control circuit 450 between the display control circuit 400 and the first and second scanning signal line driver circuits 210 and 220. More specifically, the waveform control circuit 450 is connected to the clock-transmission signal lines Lck and Lckb, as shown in FIG. 11. The waveform control circuit 450 includes a first circuit having a first switching element SW1 and a first capacitor Cd1 connected in series thereto and a second circuit having a second switching element SW2 and a second capacitor Cd2 connected in series thereto, and in the configuration shown in FIG. 11, as the first and second switching elements SW1 and SW2, P-channel transistors (abbreviated below as "P-ch transistors") are used. The waveform control circuit 450 is configured such that the first clock-transmission signal line Lck for transmitting the normal-phase gate clock signal GCK is grounded via the first circuit, and the second clock-transmission signal line Lckb for transmitting the reverse-phase gate clock signal GCKB is grounded via the second circuit. The display control circuit 400 generates control signals for performing on/off control on the first and second switching elements SW1 and SW2, as delay control signals Cd1*y*, which are provided to gate terminals of the P-ch transistors serving as the first and second switching elements SW1 and SW2.

Figure 12:
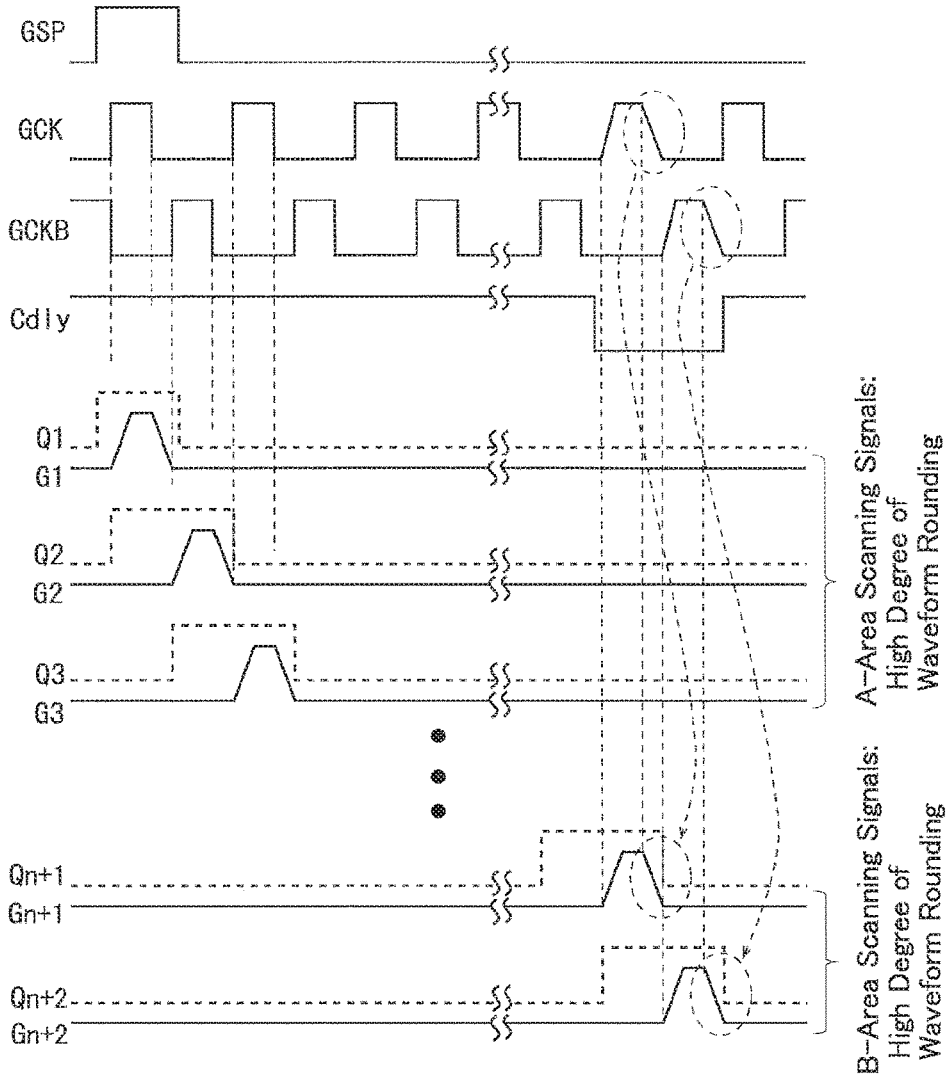
FIG. 12 is a signal waveform chart describing operational advantages of the second embodiment.

FIG. 12 is a signal waveform chart describing operational advantages of the present embodiment as described above. The delay control signal Cd1*y* is active (i.e., L-level) during a period in which pulses of the gate clock signals GCK and GCKB that correspond to the scanning signals $G_{n+1}$ to $G_{n+p}$ (in the example shown in FIG. 11, p=2) to be applied to the area-B scanning signal lines $GL_{n+1}$ to $GL_{n+p}$ occur, and during other periods, the delay control signal Cd1*y* is inactive (i.e., H-level). During the period in which the delay control signal Cd1*y* is active, the first and second switching elements SW1 and SW2 in the waveform control circuit 450 are in ON-state, and therefore, the first capacitor Cd1 and the second capacitor Cd2 are respectively coupled to the first clock-transmission signal line Lck for transmitting the normal-phase gate clock signal GCK and the second clock-transmission signal line Lckb for transmitting the reverse-phase gate clock signal GCKB. Accordingly, the normal-phase gate clock signal GCK has a waveform rounded in accordance with a time constant determined by resistance and capacitance of the first clock-transmission signal line Lck and the first capacitor Cd1, and the reverse-phase gate clock signal GCKB has a waveform rounded in accordance with a time constant determined by resistance and capacitance of the second clock-transmission signal line Lckb and the second capacitor Cd2. Therefore, in the present embodiment, on the basis of the difference in time constant between the area-A scanning signal line $GL_i$ (where i=1 to n) and the area-B scanning signal line $GL_{n+k}$ (where k=1 to p), capacitance values of the first capacitor Cd1 and the second capacitor Cd2 are set, considering the resistance and the capacitance of each of the first and second clock-transmission signal lines Lck and Lckb, such that the area-B pixel voltage reduction amount $\Delta V_B$ becomes approximately equal to the area-A pixel voltage reduction amount $\Delta V_A$ (see FIG. 6).

In the present embodiment as described above, even when the display panel 100 has the notch 120 as shown in FIGS. 1 and 2, the scanning signals $G_1$ to $G_{n+p}$ applied to the scanning signal lines $GL_1$ to $GL_{n+p}$ of the display panel 100 have waveforms rounded almost to the same degree (i.e., the scanning signals $G_1$ to $G_{n+p}$ have almost the same on-to-off transition period at the fall), as shown in FIG. 12, and therefore, in any pixel forming portion 10 (either the area-A pixel forming portion or the area-B pixel forming portion), the pixel voltage reduction amount ΔVp (either the area-A pixel voltage reduction amount $\Delta V_A$ or the area-B pixel voltage reduction amount $\Delta V_B$) is almost the same. Thus, the present embodiment also renders it possible to achieve effects similar to those achieved by the first embodiment.

It should be noted that in the present embodiment, the waveform control circuit 450 is configured using capacitive elements and switching elements, as shown in FIG. 11, but such a configuration is not limiting, and any configuration may be employed so long as the waveforms of the gate clock signals GCK and GCKB are rounded in order to equalize the pixel voltage reduction amount ΔVp in the display panel 100. For example, the first and second clock-transmission signal lines Lck and Lckb may be respectively connected to capacitors switchable to other capacitors with different capacitance values, and a feature may be included so as to switch between inserting and not inserting a resistive element into each of the first and second clock-transmission signal lines Lck and Lckb.

Figure 13:
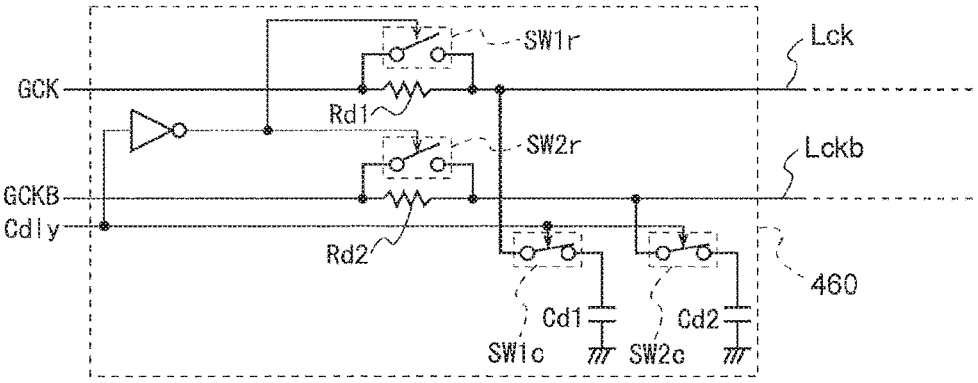
FIG. 13 is a circuit diagram illustrating another configuration example of a waveform control circuit in the second embodiment.

FIG. 13 illustrates as a variant of the waveform control circuit 450 a waveform control circuit 460 including a feature that switches between connecting and not connecting the first and second capacitors Cd1 and Cd2 to the first and second clock-transmission signal lines Lck and Lckb as loads and also a feature that switches between inserting and not inserting first and second resistive elements Rd1 and Rd2 into the first and second clock-transmission signal lines Lck and Lckb. When the delay control signal Cd1*y* from the display control circuit 400 becomes active (in FIG. 12, L-level), switches SW1*r* and SW2*r* and switches SW1*c* and SW2*c* in the waveform control circuit 460 are respectively rendered in OFF- and ON-states. As a result, the first and second resistive elements Rd1 and Rd2 are respectively inserted into the first and second clock-transmission signal lines Lck and Lckb, and the first and second capacitors Cd1 and Cd2 are connected as loads, as shown in FIG. 13. Consequently, the waveform of the normal-phase gate clock signal GCK is rounded in accordance with a time constant determined by resistance and capacitance of the first clock-transmission signal line Lck, the first resistive element Rd1, and the first capacitor Cd1, and the waveform of the reverse-phase gate clock signal GCKB is rounded in accordance with a time constant determined by resistance and capacitance of the second clock-transmission signal line Lckb, the second resistive element Rd2, and the second capacitor Cd2. Note that when the delay control signal Cd1*y* becomes inactive, the switches SW1*r* and SW2*r* and the switches SW1*c* and SW2*c* are respectively rendered in ON-and OFF-states, and therefore, the first and second resistive elements Rd1 and Rd2 are not inserted into the first and second clock-transmission signal lines Lck and Lckb as well as the first and second capacitors Cd1 and Cd2 are disconnected from the first and second clock-transmission signal lines Lck and Lckb.

3. Third Embodiment

While in the first and second embodiments, the display panel 100 is configured to have the notch 120 as shown in FIGS. 1 and 2, other active-matrix liquid crystal display devices with non-rectangular display panels can also have a feature that controls the waveforms of the gate clock signals GCK and GCKB in order to equalize the pixel voltage reduction amount ΔVp. Accordingly, as a third embodiment, a liquid crystal display device with a circular display panel will be described below. In the following, elements of the present embodiment that are the same as or correspond to those of the first embodiment are denoted by the same reference characters, and any detailed descriptions thereof will be omitted.

Figure 14:
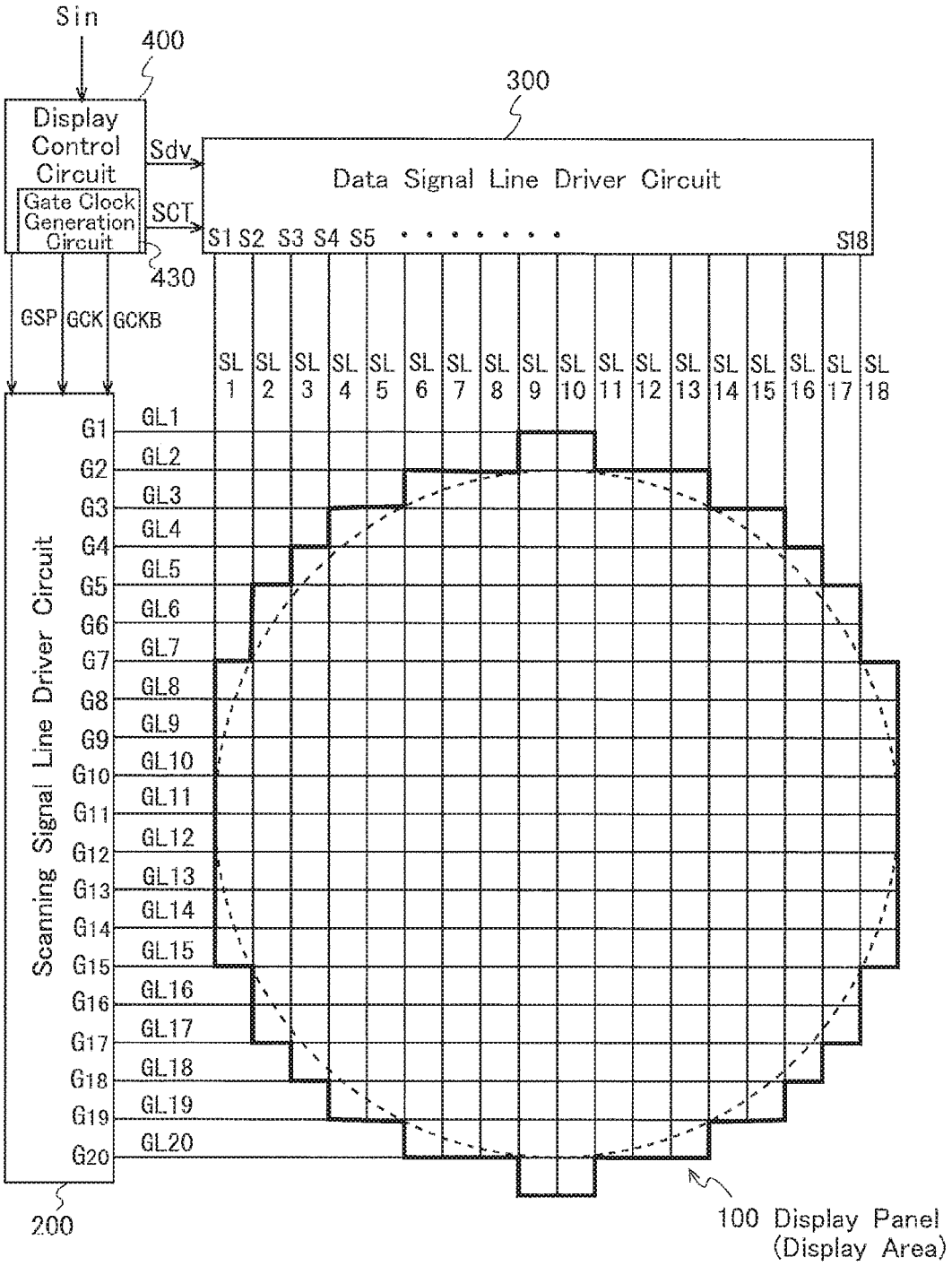
FIG. 14 is a diagram describing a configuration of a liquid crystal display device according to a third embodiment.

FIG. 14 is a diagram describing the configuration of the liquid crystal display device according to the third embodiment. In the present embodiment, unlike in the first and second embodiments, the display panel 100 of the liquid crystal display device has a circular display area, and correspondingly, the gate clock generation circuit 430 in the display control circuit 400 is configured differently from the first embodiment. Moreover, the liquid crystal display device includes only one scanning signal line driver circuit 200 connected to one end of each of the scanning signal lines $GL_1$ to $GL_{20}$ of the display panel 100. Note that in the configuration shown in FIG. 14, for convenience of illustration and description, the display panel 100 has 20 scanning signal lines and 18 data signal lines, but the numbers of scanning signal lines and data signal lines are not limited to these. In addition, in the circular display area of the display panel 100, the pixel forming portions 10 configured as shown in FIG. 3(A) are provided corresponding to intersections of the data signal lines $SL_j$ and the scanning signal lines $GL_i$.

Figure 15:
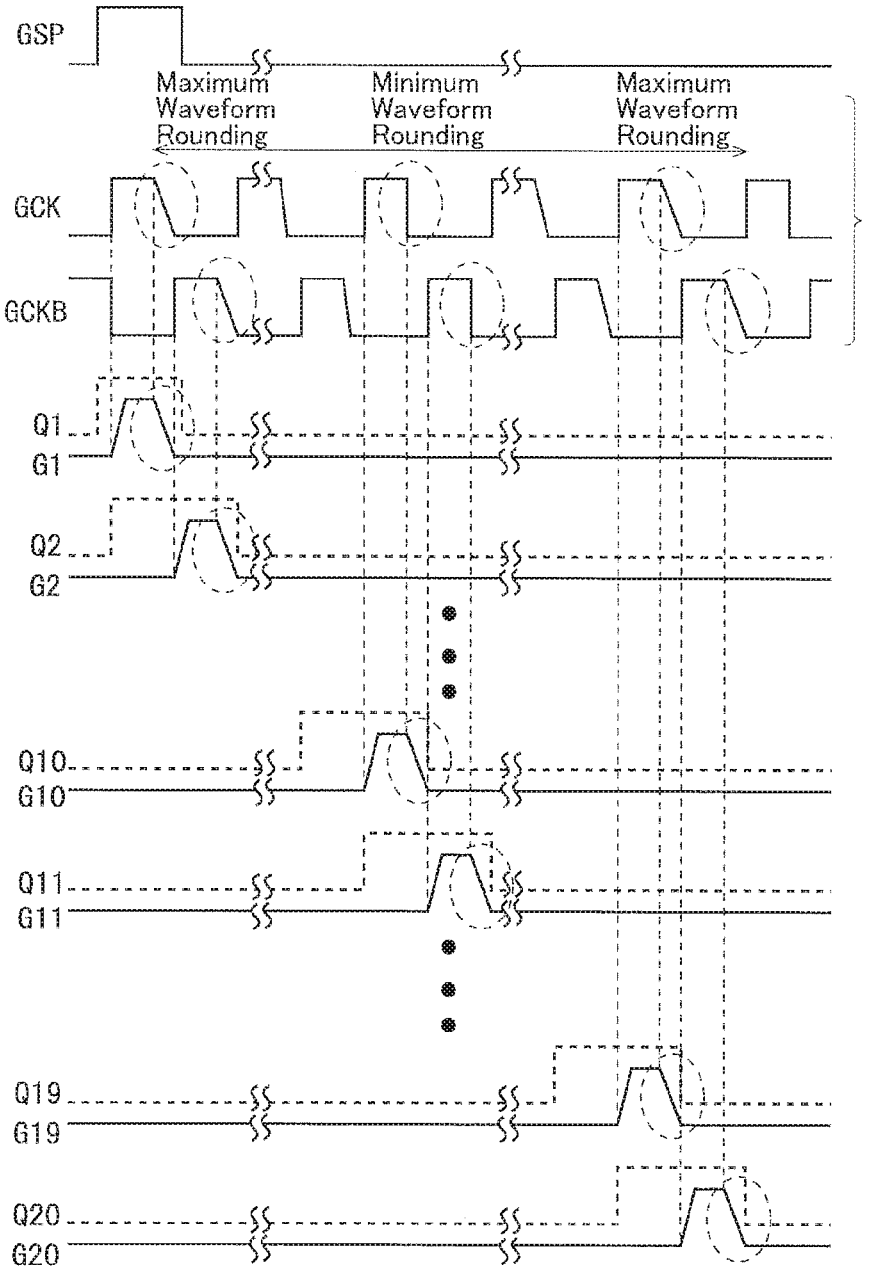
FIG. 15 is a signal waveform chart describing operational advantages of the third embodiment.

FIG. 15 is a signal waveform chart describing operational advantages of the present embodiment. In the present embodiment, as in the first embodiment, the gate start pulse signal GSP and the gate clock signals GCK and GCKB, all of which are generated by the display control circuit 400, are inputted to the scanning signal line driver circuit 200. However, in the present embodiment, as shown in FIG. 14, the scanning signal lines $GL_1$ to $GL_{20}$ of the display panel 100 have different lengths and correspondingly different time constants (i.e., different values of capacitance and resistance). Accordingly, in the present embodiment, the gate clock generation circuit 430 in the display control circuit 400 is configured to generate the gate clock signals GCK and GCKB with falling waveforms rounded in accordance with the difference in time constant among the scanning signal lines $GL_1$ to $GL_{20}$ of the display panel 100, as shown in FIG. 15. More specifically, the degree to which the falling waveforms of the gate clock signals GCK and GCKB are rounded (i.e., the fall time that corresponds to the duration of the on-to-off transition period for the TFT 12 of the pixel forming portion 10) is set on the basis of the difference in time constant among the scanning signal lines $GL_1$ to $GL_{20}$, such that the pixel voltage reduction amount $\Delta Vp$ is approximately equal among the pixel forming portions 10 in the display panel 100. Accordingly, as shown in FIG. 15, among all pulses included in the gate clock signals GCK and GCKB during each frame period, closest pulses to a midpoint of the frame period have falling waveforms rounded to a minimum degree (i.e., the duration of the on-to-off transition period at the fall is minimum), the degree to which the falling waveform is rounded increases with the distance from the midpoint, and closest pulses to the start or the end of the frame period have falling waveforms rounded to a maximum degree.

In the present embodiment as described above, even when the display panel 100 has a circular display area as shown in FIG. 14, the degree to which the falling waveform is rounded (i.e., the duration of the on-to-off transition period at the fall) is approximately equal among the scanning signals $G_1$ to $G_{20}$ applied to the scanning signal lines $GL_1$ to $GL_{20}$ of the display panel 100, as shown in FIG. 15, and therefore, in any pixel forming portion 10, the pixel voltage reduction amount $\Delta Vp$ is approximately equal. Thus, the present embodiment also renders it possible to achieve effects similar to those achieved by the first embodiment.

4. Other Variants

The present invention is not limited to the above embodiments and variants thereof, and diverse variations can be made without departing from the scope of the invention.

For example, in the embodiments and variants thereof, the N-ch transistor (N-channel TFT) 12 is used as the pixel switching element of the pixel forming portion 10 (see FIG. 3), but a P-ch transistor (P-channel TFT) may be used as the pixel switching element. In the case where the P-ch transistor is used as the pixel switching element, the on-voltage and the off-voltage respectively correspond to the L-level gate voltage Vgl and the H-level gate voltage Vgh, the waveform control circuit 423 and the waveform control circuit 450 are configured to round the rising waveforms of the gate clock signals GCK and GCKB (i.e., to set the duration of the on-to-off transition period at the rise) on the basis of the difference in time constant among the scanning signal lines of the display panel 100.

Furthermore, in the embodiments, the scanning signal line driver circuits 210, 220, and 200 (shown in FIGS. 2, 11, and 14) are configured to operate in accordance with the two-phase clock signal consisting of the normal-phase and reverse-phase gate clock signals GCK and GCKB (see FIG. 4), but such a configuration is not limiting. Specifically, even when the scanning signal line driver circuit operates in accordance with a single-phase gate clock signal or a multi-phase gate clock signal having three or more phases, effects similar to those achieved by the embodiments can be achieved by including a circuit similar to the waveform control circuit 423, 450, or 460 in the embodiments, so long as pulses included in the gate clock signal are outputted as scanning signals via analog switches. Note that in the case where the scanning signal line driver circuit operates in accordance with a multi-phase gate clock signal having three or more phases, the multi-phase gate clock signal cyclically corresponds to the analog switches $\mathbf{22}_1$, $\mathbf{22}_2$, $\mathbf{22}_3$, . . . , of the scanning signal line driver circuit, so that to each analog switch $\mathbf{22}_i$, a corresponding one of the gate clock signals that constitute the multi-phase gate clock signal is inputted.

Furthermore, in the embodiments, the waveform control circuit 423, 450, or 460 is provided in order to round the waveforms of the gate clock signals GCK and GCKB in accordance with the difference in length (i.e., time constant) among the scanning signal lines $GL_1$ to $GL_n$, but the waveform control circuit is not limited to any specific configuration, so long as functions similar to those of the waveform control circuits 423, 450, and 460 in the embodiments can be realized. For example, the gate clock signals GCK and GCKB may be controlled in terms of slew rate for falling or rising waveforms corresponding to the on-to-off transition period.

While the above embodiments have been described taking as an example the liquid crystal display device, the present invention is not limited to this and can also be applied to other types of display devices such as an organic EL (electroluminescent) display device, so long as such display devices are active-matrix display devices.

It should be noted that the features of the display devices according to the above-described embodiments and variants thereof can be arbitrarily combined unless contrary to the nature thereof, thereby configuring display devices according to diverse variants. While the invention has been described in detail, the foregoing description is in all aspects illustrative and not restrictive. It is understood that numerous other modifications and variations can be devised without departing from the scope of the invention.

What is claimed is:

1. An active-matrix display device comprising:

a display portion including a plurality of data signal lines, a plurality of scanning signal lines crossing the data signal lines, and a plurality of pixel forming portions arranged in a matrix along the data signal lines and the scanning signal lines, at least two of the scanning signal lines being different in time constant from each other;

a scanning signal line driver circuit configured to generate a plurality of scanning signals respectively provided to the scanning signal lines;

a scanning clock generation circuit configured to generate a scanning clock signal to be provided to the scanning signal line driver circuit; and a waveform control circuit configured to control a waveform of the scanning clock signal, the waveform control circuit being provided inside or outside the scanning clock generation circuit, wherein, each of the pixel forming portions includes:

a capacitive electrode serving as one of electrodes that form predetermined capacitance; and a field-effect transistor serving as a pixel switching element and having a first conduction terminal connected to one of the data signal lines, a second conduction terminal connected to the capacitive electrode, and a control terminal connected to one of the scanning signal lines, the scanning signal line driver circuit includes:

a shift register configured to sequentially transfer an inputted start pulse and having stages corresponding in number to the scanning signal lines; and a plurality of analog switches respectively connected to the scanning signal lines and being respectively turned on or off by output signals from the stages of the shift register that correspond to the scanning signal lines to which the analog switches are connected, the scanning signal line driver circuit applies a plurality of signals respectively to the scanning signal lines as the scanning signals, the plurality of signals being obtained by sampling the scanning clock signal by the analog switches, and the waveform control circuit controls the waveform of the scanning clock signal such that a time period taken for a voltage of the scanning clock signal to change from an on-voltage for rendering the pixel switching element in ON-state to an off-voltage for rendering the pixel switching element in OFF-state, at a fall or rise of a pulse included in the scanning clock signal, increases as the scanning signal line to which a scanning signal including the pulse is to be applied decreases in time constant.

2. The active-matrix display device according to claim 1, wherein, the scanning clock generation circuit generates a multiphase clock signal consisting of two or more clock signals, as the scanning clock signal, and the two or more clock signals cyclically correspond to the analog switches so that a corresponding one of the two or more clock signals is inputted to each analog switch.

3. The active-matrix display device according to claim 2, wherein, the scanning clock generation circuit generates a two-phase clock signal consisting of a normal-phase clock signal and a reverse-phase clock signal, as the scanning clock signal, the normal-phase clock signal is inputted to odd-numbered analog switches among the analog switches of the scanning signal line driver circuit, and the reverse-phase clock signal is inputted to even-numbered analog switches among the analog switches of the scanning signal line driver circuit.

4. The active-matrix display device according to claim 1, wherein, the scanning signal line driver circuit includes:

a first scanning signal line driver circuit connected to first ends of the scanning signal lines; and a second scanning signal line driver circuit connected to second ends of the scanning signal lines, each of the first and second scanning signal line driver circuits includes the shift register and the analog switches, the first scanning signal line driver circuit applies a plurality of signals respectively to the first ends of the scanning signal lines as the scanning signals, the plurality of signals being obtained by sampling the scanning clock signal by the analog switches, the second scanning signal line driver circuit applies a plurality of signals respectively to the second ends of the scanning signal lines as the scanning signals, the plurality of signals being obtained by sampling the scanning clock signal by the analog switches, and the display portion has a notch, by which each predetermined line from among the scanning signal lines is divided into two signal lines electrically separated from each other.

5. The active-matrix display device according to claim 1, wherein the waveform control circuit includes:

a capacitive element; and a connection-switching circuit configured to control the waveform of the scanning clock signal by switching between connecting and not connecting the capacitive element as a load to a signal line for transmitting the scanning clock signal from the scanning clock generation circuit to the scanning signal line driver circuit.

6. The active-matrix display device according to claim 1, wherein the waveform control circuit includes:

a resistive element; and a connection-switching circuit configured to control the waveform of the scanning clock signal by switching between inserting and not inserting the resistive element into a signal line for transmitting the scanning clock signal from the scanning clock generation circuit to the scanning signal line driver circuit.

7. A method for driving an active-matrix display device provided with a display portion including a plurality of data signal lines, a plurality of scanning signal lines crossing the data signal lines, and a plurality of pixel forming portions arranged in a matrix along the data signal lines and the scanning signal lines, at least two of the scanning signal lines being different in time constant from each other, the method comprising:

a scanning signal line driving step of generating a plurality of scanning signals respectively provided to the scanning signal lines;

a scanning clock generation step of generating a scanning clock signal for generating the scanning signals in the scanning signal line driving step; and a waveform control step of controlling a waveform of the scanning clock signal, wherein, each of the pixel forming portions includes:

a capacitive electrode serving as one of electrodes that form predetermined capacitance; and a field-effect transistor serving as a pixel switching element and having a first conduction terminal connected to one of the data signal lines, a second conduction terminal connected to the capacitive electrode, and a control terminal connected to one of the scanning signal lines, the scanning signal line driving step includes:

sequentially transferring an inputted start pulse within a shift register having stages corresponding in number to the scanning signal lines;

turning on or off a plurality of analog switches respectively connected to the scanning signal lines by respective output signals from the stages of the shift register that correspond to the scanning signal lines to which the analog switches are connected; and applying a plurality of signals respectively to the scanning signal lines as the scanning signals, the plurality of signals being obtained by sampling the scanning clock signal by the analog switches, and in the waveform control step, the waveform of the scanning clock signal is controlled such that a time period taken for a voltage of the scanning clock signal to change from an on-voltage for rendering the pixel switching element in ON-state to an off-voltage for rendering the pixel switching element in OFF-state, at a rise or fall of a pulse included in the scanning clock signal, increases as the scanning signal line to which a scanning signal including the pulse is to be applied decreases in time constant.

8. The method according to claim 7, wherein in the waveform control step, the waveform of the scanning clock signal is controlled by switching between connecting and not connecting a capacitive element as a load to a signal line for transmitting the scanning clock signal generated in the scanning clock generation step.

9. The method according to claim 7, wherein in the waveform control step, the waveform of the scanning clock signal is controlled by switching between inserting and not inserting a resistive element into a signal line for transmitting the scanning clock signal generated in the scanning clock generation step.

* * * * *